US007938304B2

(12) United States Patent
Yagi

(10) Patent No.: US 7,938,304 B2
(45) Date of Patent: May 10, 2011

(54) ELECTRIC STAPLER

(75) Inventor: Nobuaki Yagi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 125 days.

(21) Appl. No.: 12/089,343

(22) PCT Filed: Oct. 5, 2006

(86) PCT No.: PCT/JP2006/319994

§ 371 (c)(1),
(2), (4) Date: Apr. 4, 2008

(87) PCT Pub. No.: WO2007/043446

PCT Pub. Date: Apr. 19, 2007

(65) Prior Publication Data

US 2009/0114695 A1 May 7, 2009

(30) Foreign Application Priority Data

Oct. 7, 2005 (JP) ..... 2005-295167

(51) Int. Cl.
*B27F 7/36* (2006.01)

(52) U.S. Cl. ..... 227/131; 227/2; 227/120

(58) Field of Classification Search ..... 227/131, 227/111, 110, 155, 135, 78, 120, 95, 98, 227/2; 270/58.11
See application file for complete search history.

(56) References Cited

U.S. PATENT DOCUMENTS

| | | | | |
|---|---|---|---|---|
| 4,623,082 | A | 11/1986 | Kurosawa | |
| 6,050,471 | A * | 4/2000 | Yagi | 227/119 |
| 6,474,633 | B1 * | 11/2002 | Hirai | 270/58.09 |
| 6,550,757 | B2 * | 4/2003 | Sesek | 270/58.09 |
| 6,592,115 | B2 * | 7/2003 | Yamaguchi | 270/58.08 |
| 2005/0242149 | A1 * | 11/2005 | Higuchi | 227/2 |

FOREIGN PATENT DOCUMENTS

| | | |
|---|---|---|
| JP | 9-240856 | 9/1997 |
| JP | 2005-35151 | 2/2005 |

* cited by examiner

*Primary Examiner* — Rinaldi I Rada
*Assistant Examiner* — Nathaniel Chukwurah
(74) *Attorney, Agent, or Firm* — Drinker Biddle & Reath LLP

(57) ABSTRACT

An electric stapler includes a staple sheet storage portion for storing a stack of staple sheets, a magazine storage portion disposed on a rear side of the staple sheet storage portion to store a staple magazine, a first staple feed mechanism operable to pull out a staple sheet from the staple magazine and to feed the staple sheet to the staple sheet storage portion, and a second staple feed mechanism operable to pull out the staple sheet from the staple sheet storage portion and to feed the staple sheet to a driver unit. According to this configuration, a continuous binding processing beyond a capacity of the staple magazine becomes possible by suitably replacing the staple magazine.

8 Claims, 19 Drawing Sheets

ELECTRIC STAPLER

TECHNICAL FIELD

The present invention relates to an electric stapler and, specifically, to an electric stapler in which staple storage capacity is increased to enable a large amount of binding processing.

BACKGROUND ART

An electric stapler, which realizes a large amount of binding processing using a staple magazine in which staple sheets composed of parallel bonded linear metal lines are stacked, is widely used as a stand-alone type stapler or such that it is incorporated in a copying machine or the like. The lower-most layer sheet of the stacked staple sheets inside the staple magazine is fed toward right below a driver by a feed pawl included in the staple feed mechanism of the electric stapler disclosed, e.g., in JP 2005-35151A, and the linear staple of the leading end portion of the lower-most layer sheet is bent formed into a gate shape by a forming plate, is driven by the driver to penetrate through papers, and the leg portion of the staple is bent by a clincher situated on the lower surface side of the papers, whereby the papers are bound.

In the electric stapler using the staple magazine with the linear staple sheets stored therein, since the staple sheets in the lower-most layer inside the staple magazine are fed out sequentially, while the electric stapler is in use, the staple sheet in the lower-most layer is being pulled from the inside of the staple magazine toward the staple guide of the electric stapler. Therefore, in a state where the staple sheet mounts on both the inside of the staple magazine and the staple guide of the electric stapler, the staple magazine cannot be taken out but, when the staple sheets are used up, the staple magazine can be replaced.

As described above, in a case where the staple magazine is replaced when the staple sheets are used up, the staple sheet must be used up during the continuous binding processing and the continuous binding processing must be stopped for replacement of the staple magazine. Also, there is found another problem: that is, even when it is previously known that the number of the staple sheets remaining in the staple magazine is small, an operator must start the binding operation and wait for the time of the replacement of the staple magazine.

DISCLOSURE OF THE INVENTION

One or more embodiments of the invention provide an electric stapler which enables a continuous binding processing beyond a capacity of a staple magazine to enhance efficiency of the binding processing.

According to one or more embodiments of the invention, an electric stapler includes a staple sheet storage portion for storing a stack of staple sheets, a magazine storage portion disposed on a rear side of the staple sheet storage portion to store a staple magazine, a first staple feed mechanism operable to pull out a staple sheet from the staple magazine and to feed the staple sheet to the staple sheet storage portion, and a second staple feed mechanism operable to pull out the staple sheet from the staple sheet storage portion and to feed the staple sheet to a driver unit. According to this configuration, a continuous binding processing beyond a capacity of the staple magazine becomes possible.

According to one or more embodiments of the invention, the electric staple further includes a lift mechanism operable to lift up the magazine storage portion.

The first staple feed mechanism feeds the staple sheet to the staple sheet storage portion in a state in which the lift mechanism keeps a height of the staple sheet to be pulled out from the staple magazine higher than a height of an upper surface of the stack of the staple sheets inside the staple sheet storage portion.

According to this configuration, since the staple sheet to be fed to the staple sheet storage portion is moved almost horizontally and is put onto the upper surface of the staple sheets inside the staple sheet storage portion, there is no fear that the staple sheet drops off obliquely inside the staple sheet storage portion to cause a jam.

According to one or more embodiments of the invention, the electric staple further includes a first sensor disposed near a staple sheet pulling-out opening of the magazine storage portion to detect whether a staple sheet is present or not, and control means. If the first sensor does not detect a presence of the staple sheet during a certain times of staple sheet feeding operations of the first staple feed mechanism, the control means judges that there are no staple sheets inside the staple magazine and displays or warns that there are no staple sheets.

By replacing the staple magazine in accordance with the display or the warning, the staple magazine can be replaced while the staple sheets remain inside the staple sheet storage portion. Thus, by replacing the staple magazine each time it is required, the continuous binding operation of the electric stapler can be executed perpetually.

According to one or more embodiments of the invention, the first staple feed mechanism includes a feed pawl, a feed pawl hold member, and a pusher disposed on a leading end of the feed pawl hold member and having an upper surface which is rearwardly inclined. The pusher is upwardly biased by a biasing member. The pusher is retracted downward when the upper surface thereof is pressed by the staple sheet while the staple sheet is being fed from the magazine storage portion to the staple sheet storage portion. The upper surface projects into a staple sheet feeding passage so that the pusher pushes a rear end of the staple sheet when the staple sheet passes through the pusher. Therefore, the entire staple sheet can be completely fed into the staple sheet storage portion by the pusher.

According to one or more embodiments of the invention, the electric stapler further includes a hold member for holding a staple sheet. A front portion of the magazine storage portion extends toward an upper side of the staple sheet storage portion and is downwardly biased by a biasing member. The hold member is disposed on the front portion of the magazine storage portion to hold the staple sheets inside the staple sheet storage portion in accordance with the downward biasing of the front portion of the magazine storage portion by the biasing member.

According to this configuration, regardless of the number of staple sheets inside the staple sheet storage portion, the staple sheets can be held and thus the staple sheets can be pulled out stably.

According to one or more embodiments of the invention, the lift mechanism includes a ratchet rack provided on the magazine storage portion and extending in a vertical direction, a lift arm to be driven up and down, and a ratchet pawl provided on the lift arm. The ratchet pawl engages with the ratchet rack only when the lift arm is moved up to lift up the magazine storage portion by a certain lift amount.

According to this configuration, with the height of the upper surface of the staple sheets stored inside the staple sheet storage portion and the height of the staple sheet pulling-out opening of the magazine storage portion controlled constant, the staple sheet can always be fed toward the upper surface of the staple sheets inside the staple sheet storage portion almost in a horizontal state, thereby eliminating a fear that the inside of the staple sheet storage portion can be clogged with staple sheets.

According to one or more embodiments of the invention, the electric stapler further includes a gate bar hanging down from a front surface of the magazine storage portion so as to be upwardly and downwardly movable. A back surface of the staple sheet storage portion is formed with an opening. The gate bar constantly closes a portion of the opening on the back surface of the staple sheet storage portion to prevent the staple sheets inside the staple sheet storage portion from moving and dropping out. This can prevent the movement and slippage of the staple sheets inside the staple sheet storage portion regardless of the installation orientation of the electric stapler.

According to one or more embodiments of the invention, the electric stapler further includes a second sensor which detects a position of a feed pawl of the second staple feed mechanism, and control means. If the second sensor detects that the feed pawl is not positioned at a previously set position, the control means does not execute an operation of the first staple feed mechanism to feed the staple sheet from the magazine storage portion to the staple sheet storage portion.

When the magazine storage portion is lifted up to feed the staple sheet, the staple sheets inside the staple sheet storage portion are not held by the magazine storage portion. At this time, when the staple feed mechanism of the staple sheet storage portion starts its staple sheet pulling-out operation, there is a fear of the poor pull-out of the staple sheet. However, owning to provision of the above-mentioned feed pawl position detecting sensor and operation control means, the occurrence of the poor pull-out of the staple sheet can be prevented.

EXPLANATION OF REFERENCE NUMERALS

Figure 1:
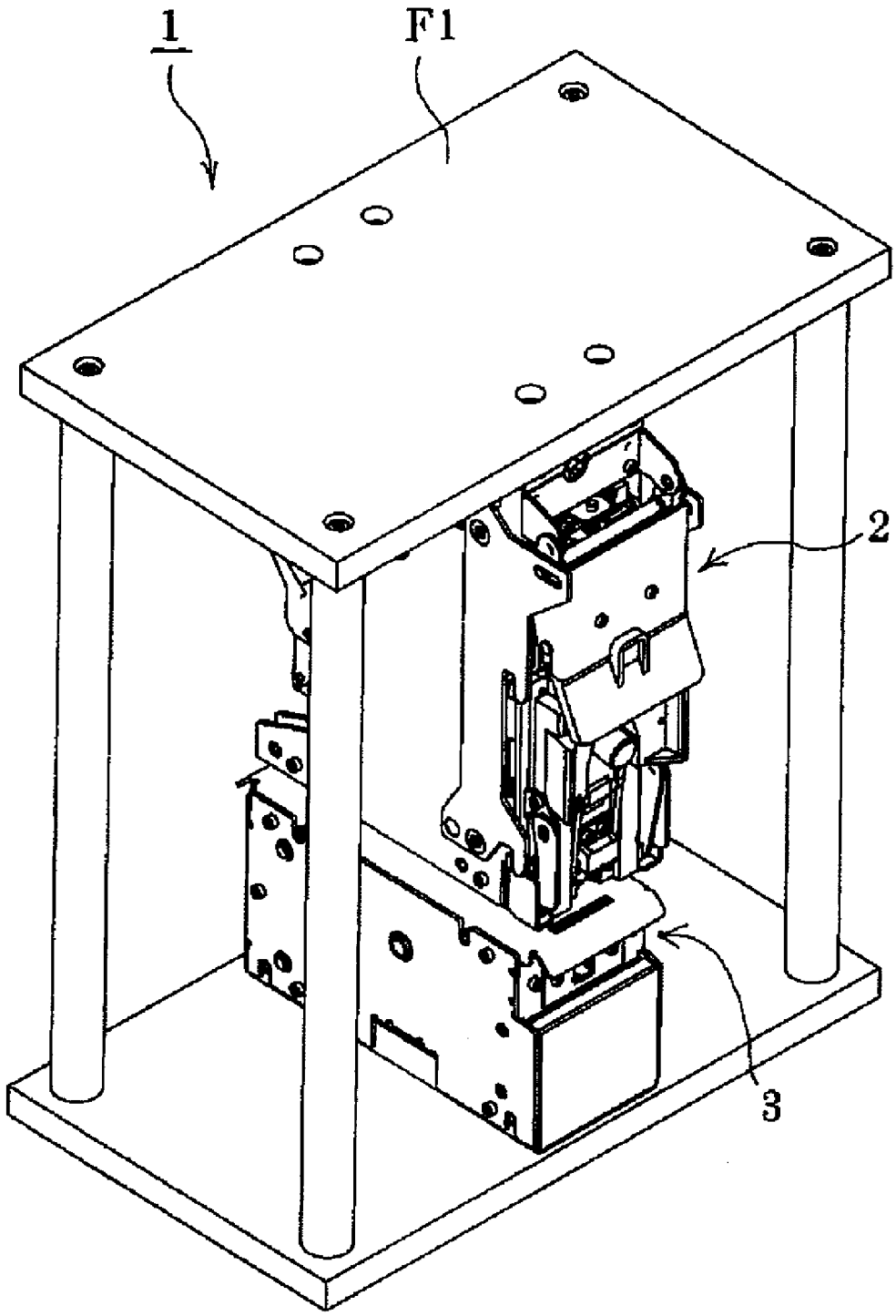
FIG. 1 is a perspective view of an electric stapler.

1 Electric stapler
2 Driver assembly
3 Clincher assembly
4 Driver drive device
5 Staple feed device
11 Magazine storage portion
12 Staple sheet storage portion
13 First staple feed mechanism
14 Second staple feed mechanism
15 Disc cam
16 Staple feed cam lever
17 Compression coil spring
18 Hold lever
19 Tension coil spring
20 Magazine lock lever
21 Lift arm
22 Ratchet pawl
23 Lift cam
24 Ratchet rack
25 Feed pawl
26 Staple sheet detecting lever
27 Staple guide

28 Slider
29 Feed pawl
30 Compression coil spring
31 Staple detecting lever
32 Pusher
33 Staple guide
34 Feed link
35 Main slider
36 Staple detecting sensor
37 Sensor actuator
38 Photo interrupter
39 Gate bar
40 Feed pawl position detecting lever
41 Photo interrupter

BEST MODE FOR CARRYING OUT THE INVENTION

Embodiment

FIG. 1 shows an electric stapler 1 which is mounted on a frame F1. The electric stapler 1 includes a driver assembly 2 mounted on the top plate of the frame F1, and a clincher assembly 3 mounted on the bottom plate of the frame F1. The driver assembly 2 and clincher assembly 3 are disposed such that they are spaced vertically from each other.

Figure 2C:
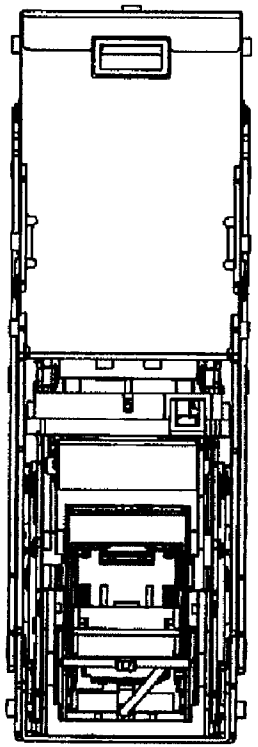
FIG. 2C is a back view of the driver assembly of the electric stapler.
Figure 2B:
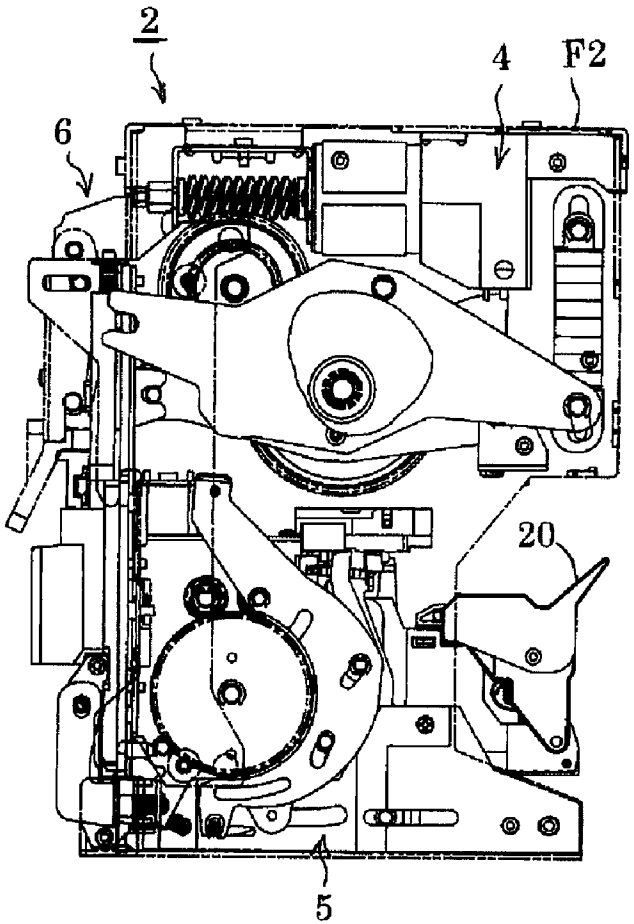
FIG. 2B is a side view of the driver assembly of the electric stapler.
Figure 2A:
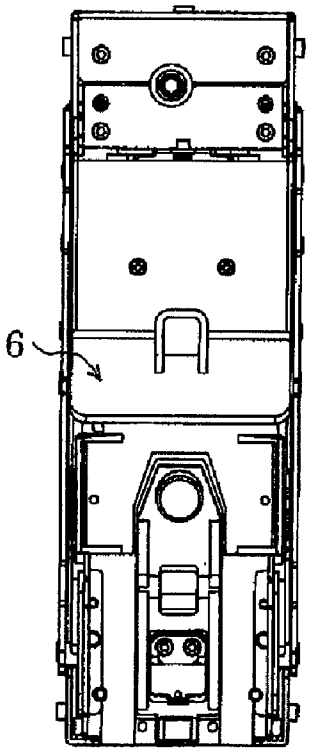
FIG. 2A is a front view of a driver assembly of the electric stapler.

FIG. 2 shows the driver assembly 2. In the upper portion of the frame F2, there is disposed a driver drive device 4 and, in the lower portion of the frame F2, there is disposed a staple feed device 5. The staple feed device 5 feeds a staple to a position right below a driver. The driver drive device 4 drives or moves up and down the driver and a forming plate (not shown) of a driver unit 6 mounted on the front surface (which is on the left in FIG. 2B) of the frame F2 to thereby eject a staple toward the clincher assembly 3 disposed downward. And, the clincher of the clincher assembly 3 clinches the leg portion of the staple jetted.

Figure 3:
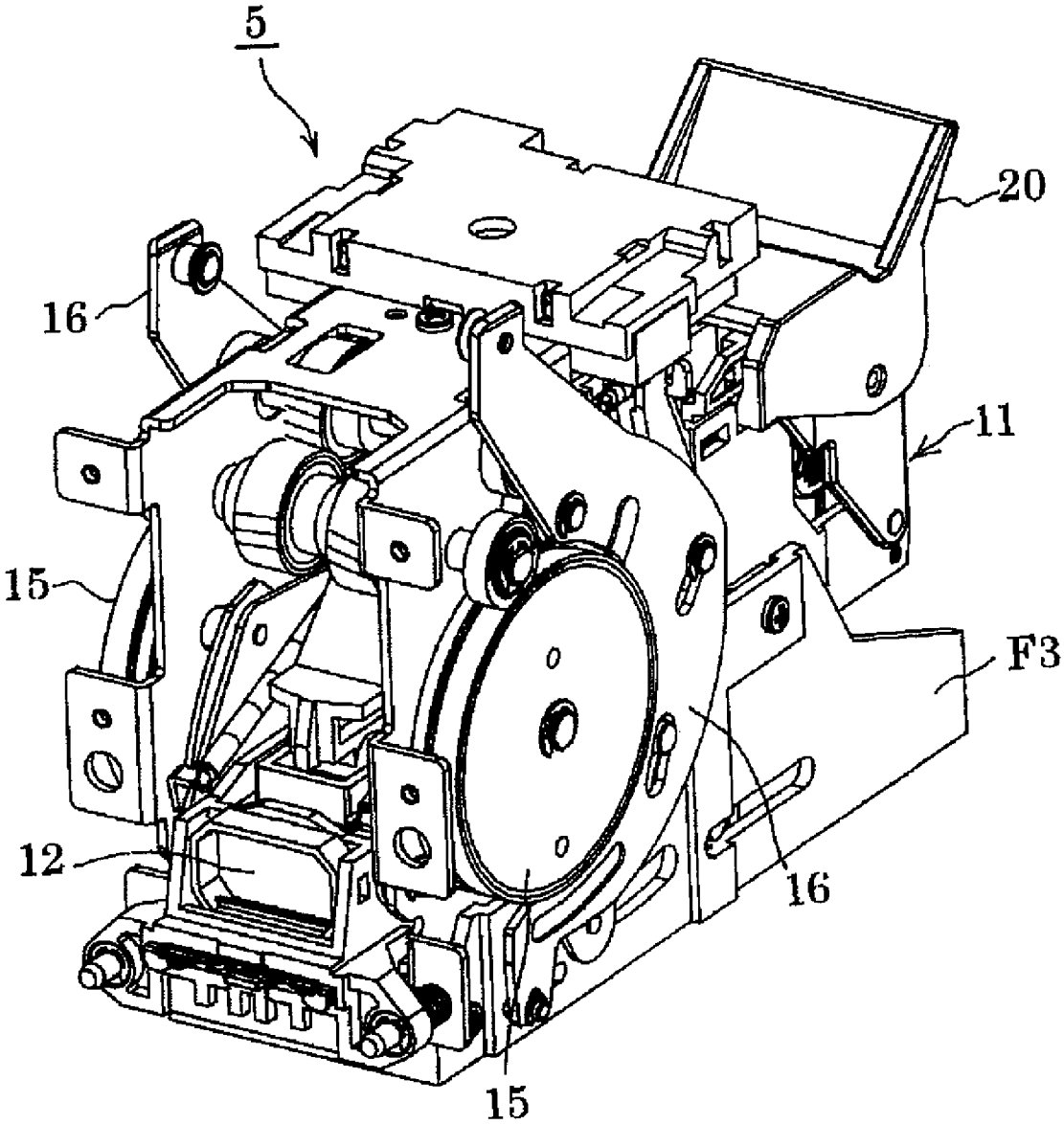
FIG. 3 is a perspective view of a staple feed device of the electric stapler.
Figure 4A:
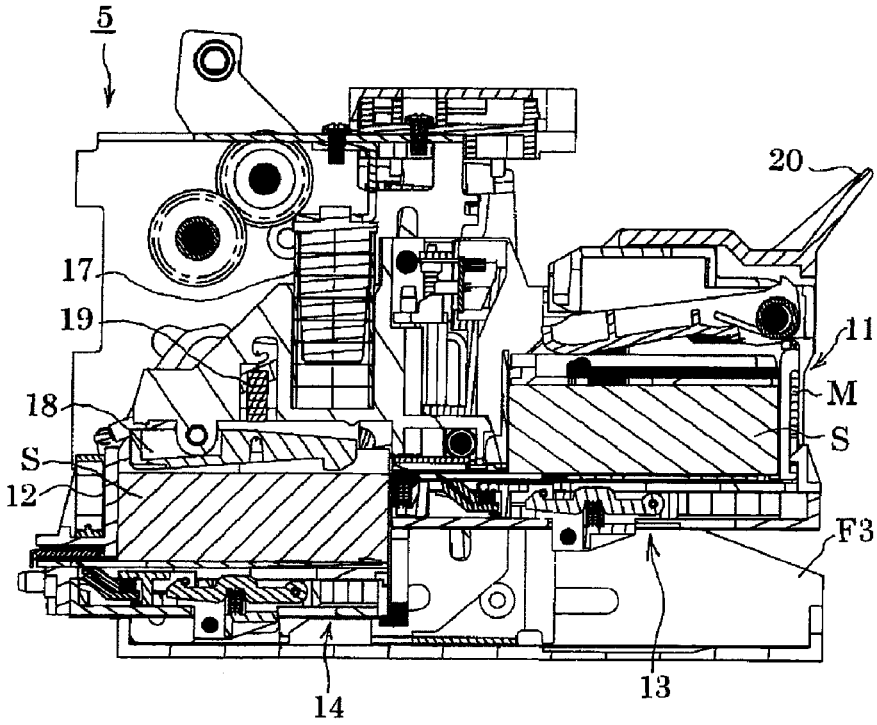
FIG. 4A is a side section view of the staple feed device.
Figure 4B:
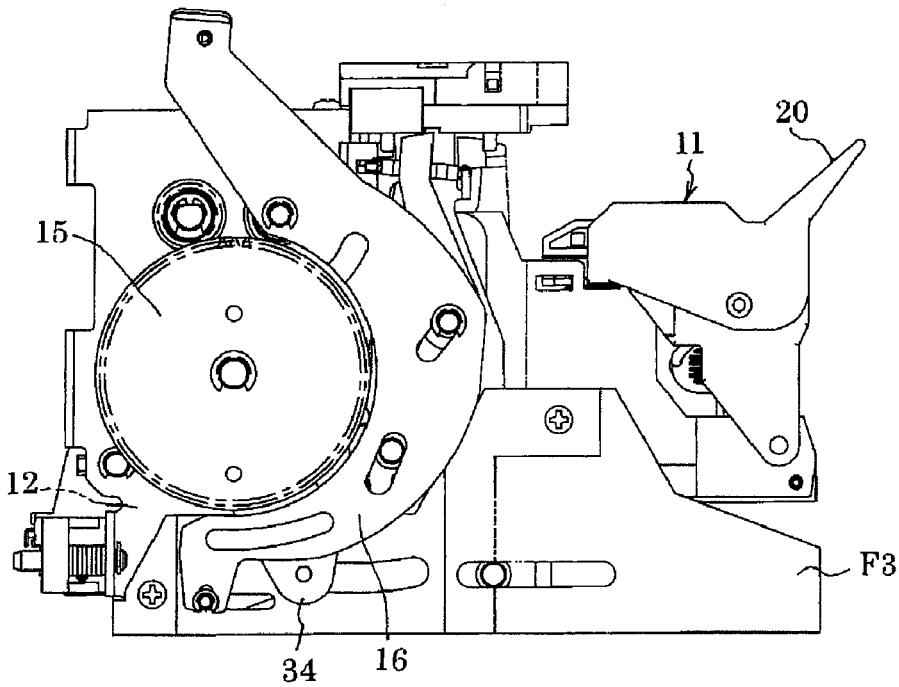
FIG. 4B is a side view of the staple feed device.

FIGS. 3, 4A and 4B respectively show the staple feed device 5 of the driver assembly 2. As shown in FIG. 4A, in the rear portion (the right portion in FIG. 4A) of the staple feed device 5, there is disposed a magazine storage portion 11 and, in front of the magazine storage portion 11, there is disposed a staple sheet storage portion 12. The staple feed device 5 feeds a staple sheet S from a staple magazine M mounted on the magazine storage portion 11 to the staple sheet storage portion 12 disposed in a forward position, and feeds out the staple sheet S forwardly to thereby carry out a binding processing.

On the respective lower surfaces of the magazine storage portion 11 and staple sheet storage portion 12, there are provided a first staple feed mechanism 13 and a second staple feed mechanism 14 respectively. These two staple feed mechanisms 13 and 14 are to be reciprocated, that is, are moved backward and forward by a staple feed cam lever 16 to be driven by a disc cam 15 shown in FIG. 4B and a feed link 34 shown in FIG. 6 and the like. Here, in the back surface of the disk cam 15, there is formed a cam groove.

The magazine storage portion 11 is assembled to a frame F3 shown in FIG. 3 through a slide guide (not shown) such that it can be moved up and down. As shown in FIG. 4A, the front portion of the magazine storage portion 11 extends toward an upper area of the staple sheet storage portion 12, while a compression coil spring 17 (a biasing member) interposed between the upper surface of the front portion of the magazine storage portion 12 and frame F3 downwardly biases the magazine storage portion 11. And, a hold lever 18 mounted on the front portion of the magazine storage portion 11 is resiliently contacted at two front and rear points with the upper surface of a staple sheet S inside the staple sheet storage portion 12.

The rear portion (staple sheet entrance side) of the hold lever 18 is upwardly biased by a tension coil spring 19. When the magazine storage portion 11 moves upward and the hold lever 18 is detached from the upper surface of the staple sheet S, the rear portion of the hold lever 18 rises upwardly of the front portion thereof, whereby, when a staple sheet is taken in, the rear portion of the hold lever 18 does not obstruct the entrance of the staple sheet.

Figure 5A:
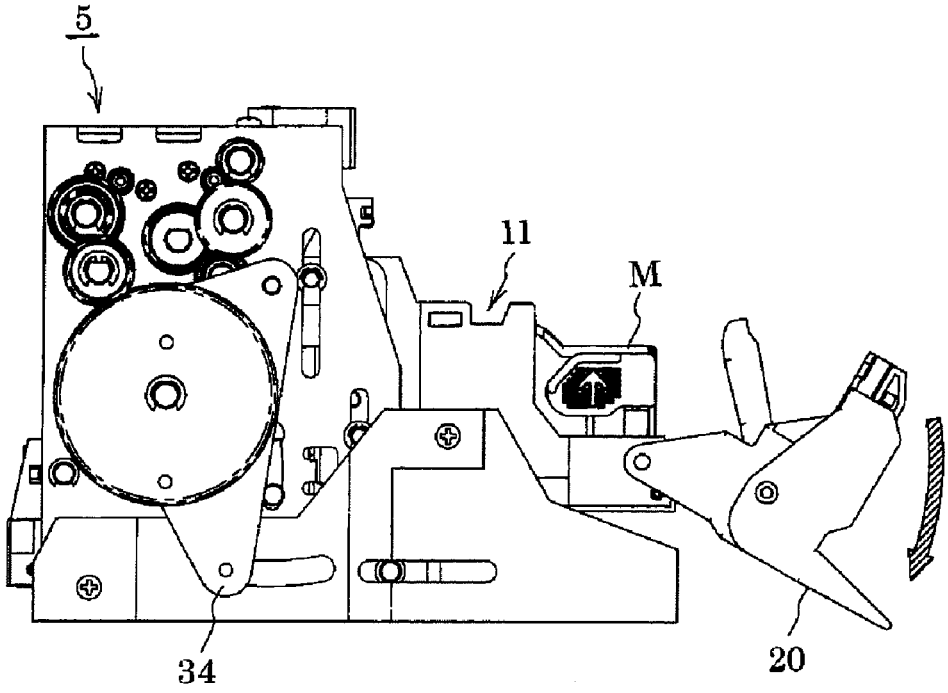
FIG. 5A is a side view showing the procedure for replacement of a staple magazine.
Figure 5B:
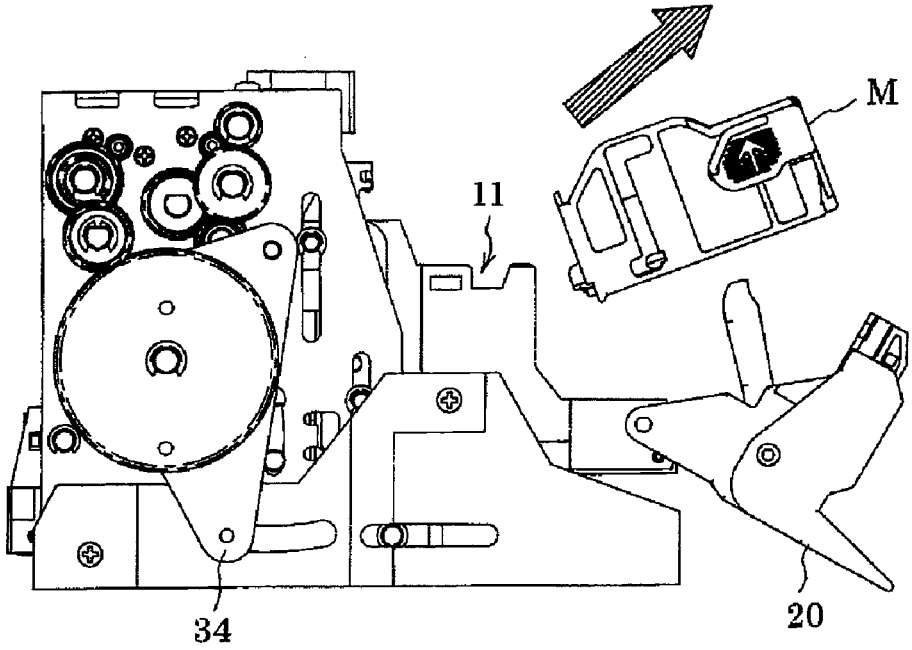
FIG. 5B is a side view showing the procedure for replacement of a staple magazine.

To replace the magazine, as shown in FIG. 5A, a magazine lock lever 20 provided on the rear end of the magazine storage portion is turned down backward to open the magazine storage portion 11 and, as shown in FIG. 5B, the staple magazine M is pulled out backwardly and a new staple magazine is loaded into the magazine storage portion 11. And, when the magazine lock lever 20 is returned to its lock position, the new staple magazine M can be fixed.

Figure 6A:
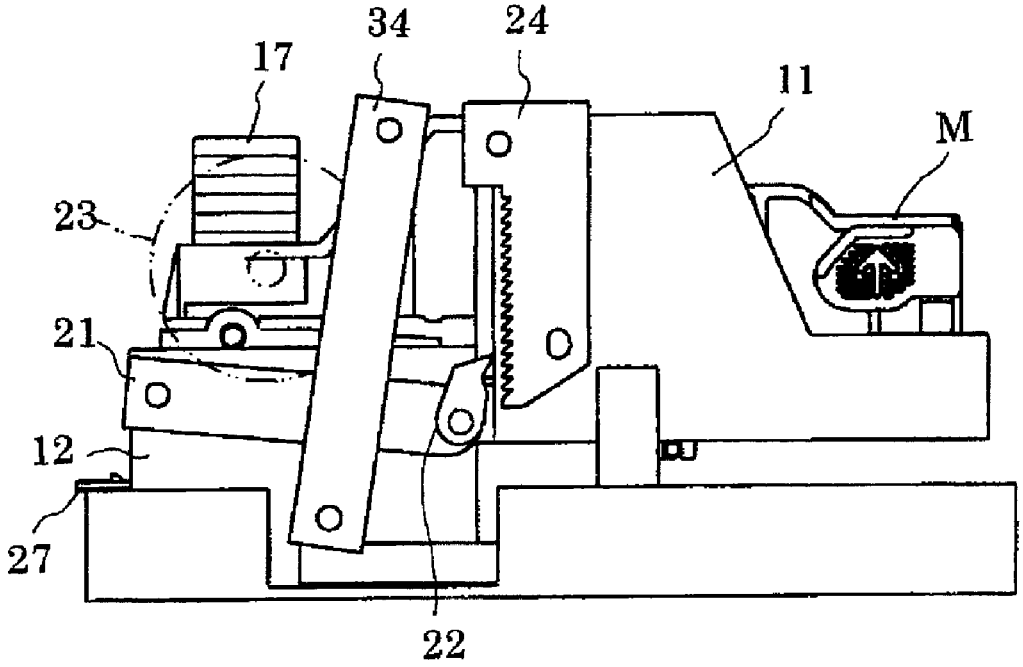
FIG. 6A is a side view of the staple feed device, showing the procedure for replacement of a staple magazine.
Figure 6B:
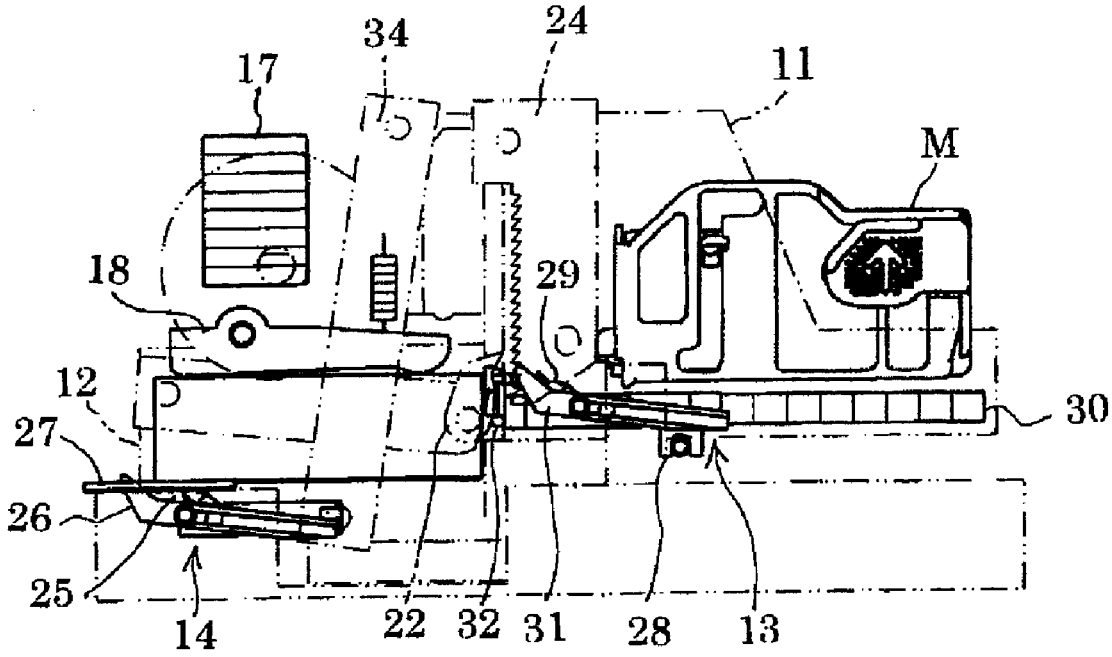
FIG. 6B is a section view of the staple feed device shown in FIG. 6A.
Figure 7A:
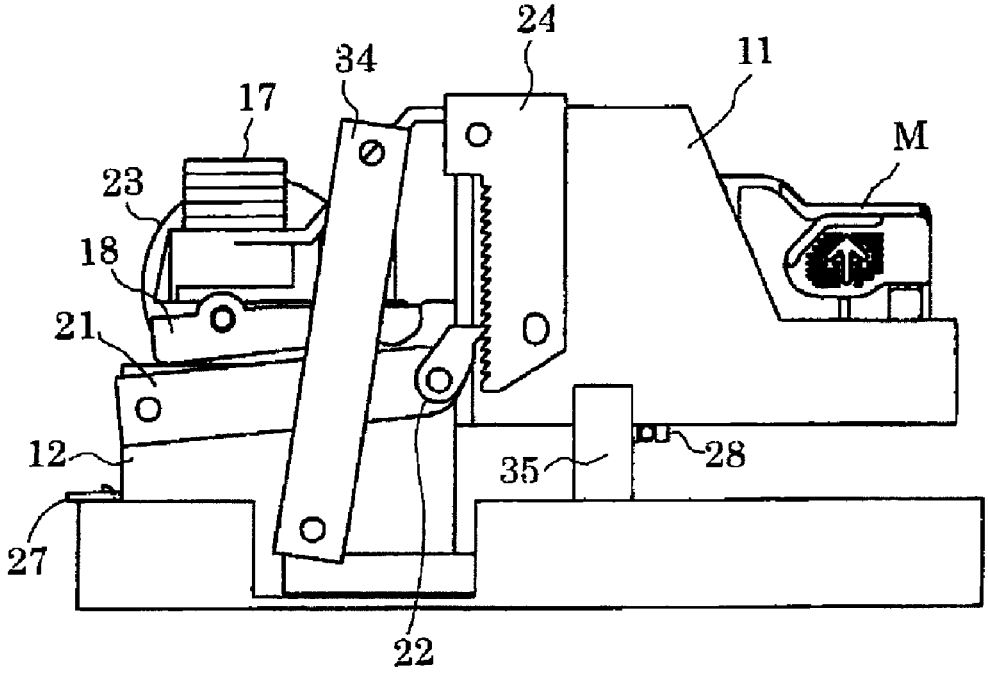
FIG. 7A is a side view of a staple feed device, showing the lift-up operation thereof.
Figure 7B:
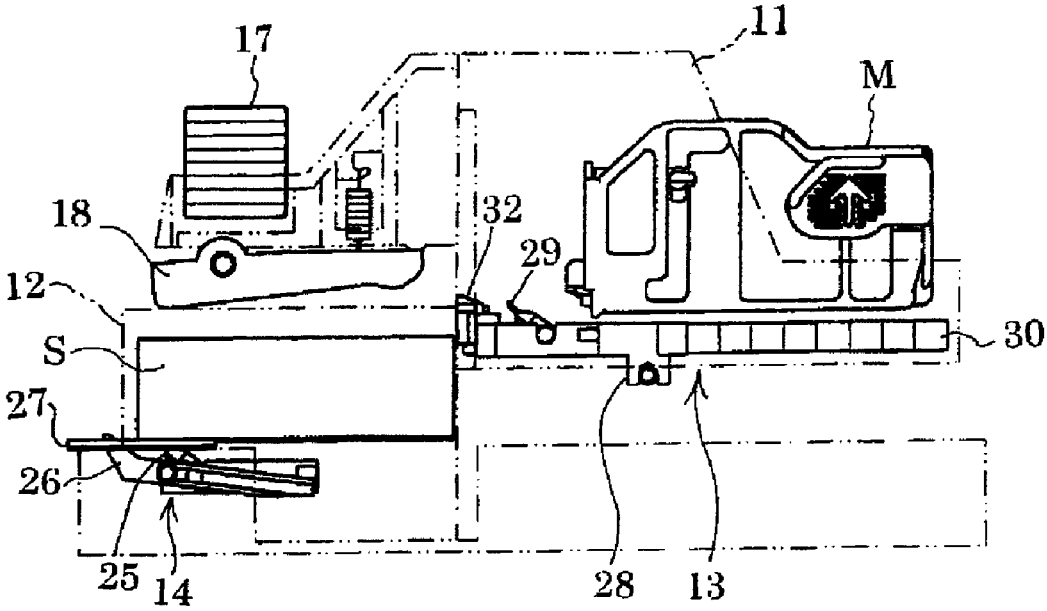
FIG. 7B is a section view of the staple feed device shown in FIG. 7A.

As shown in FIGS. 6A and 6B, on the right and left sides (in FIGS. 6A and 6B, on the front and back sides of the sheet of these figures) of the staple sheet storage portion 12, there are provided lift arms 21. Each lift arm 21 is structured such that the rear portion thereof is rotated vertically with the front end portion thereof (the left portion thereof in these figures) as a fulcrum thereof, and a ratchet pawl 22 is attached to the rear end portion of the lift arm 21. The lift arm 21 is driven, or, is moved up and down by a disk-type lift cam 23 and, as shown in FIGS. 7A and 7B, when the lift arm 21 is moved upward, the ratchet pawl 22 is engaged with a vertically extending ratchet rack 24 mounted on the magazine storage portion 11 to thereby push up the magazine storage portion 11.

When the lift arm 21 is moved downward, until the hold lever 18 of the magazine storage portion 11 is contacted with the staple sheet inside the staple sheet storage portion 12 to thereby cause the magazine storage portion 11 to stop its lowering motion, the lift arm 21 and magazine storage portion 11 move downward integrally with each other. After then, the ratchet pawl 22 is removed from the ratchet rack 24 and thus only the lift arm 21 returns to its lower end initial position.

The second staple feed mechanism 14 disposed below the staple sheet storage portion 12 has the same structure as a staple feed mechanism disclosed in JP 2005-35151A, and a slider (not shown), which is biased forwardly by a compression coil spring, forwardly pushes a feed pawl 25 (a check pawl).

The slider and feed pawl 25 can be connected together and detached from each other by click engaging means which is composed of a pawl and a securing portion or the like. When the slider pushes the feed pawl 25 forwardly, the slider and feed pawl are connected together. When the slider moves backward, the slider and feed pawl move backward together unless the feed pawl 25 blocks the backward movement.

In front of the staple sheet exit of the staple sheet storage portion 12, there is disposed a staple sheet detecting lever 26. When no staple sheet is on a staple guide 27 on the stable sheet exit side, the leading end of the staple sheet detecting lever 26 is biased by a spring (not shown) and is thereby projected upwardly from the lower surface of the staple guide 27, while the rear end of the staple sheet detecting lever 26 is rotated downwardly to retract from the passage of the feed pawl 25. In this state, as described above, the slider and feed pawl 25 are allowed to move backward together.

On the other hand, when a staple sheet is on the staple guide 27 on the staple sheet exit side, the leading end of the staple sheet detecting lever 26 is pushed down by the staple sheet, while the rear end thereof is rotated upwardly and is thereby situated in the backward movement passage of the feed pawl 25. In this state, when the feed pawl 25 slightly moves backward, the rear end of the feed pawl 25 is contacted with the stopper portion (not shown) of the rear end of the staple sheet detecting lever 26 to thereby preventing the feed pawl 25 from further moving backward, whereby only the slider is allowed to move backward.

In this manner, when a staple sheet is on the staple guide 27, the feed paws 25 retreats and advances with a short stroke to thereby feed forwardly the staple sheet pulled out upwardly onto the staple guide 27. Also, when the remaining amount of the staple sheet on the staple guide 27 is left little and the leading end of the staple sheet detecting lever 26 is thereby caused to rise, the feed pawl 25 retreats and advances with a full stroke to thereby pull out forwardly the staple sheet inside the staple sheet storage portion 12.

Similarly to the second staple feed mechanism 14 of the staple sheet storage portion 12, the first staple feed mechanism 13, which is disposed on the lower surface of the magazine storage portion 11, includes a slider 28, a feed pawl 29, a compression coil spring 30 and a staple sheet detecting lever 31. The first staple feed mechanism 13 further includes a pusher 32 disposed in front of the feed pawl 29. The pusher 32 is mounted on the leading end of a member holding the feed pawl 29 and is upwardly biased by a biasing member such as a spring (not shown). The upper surface of the pusher 32 is inclined backwardly and thus, when the pusher 32 is pushed from behind by a staple sheet, the pusher 32 can be pushed in downwardly and is thereby allowed to retract from the passage of the staple sheet.

Figure 14A:
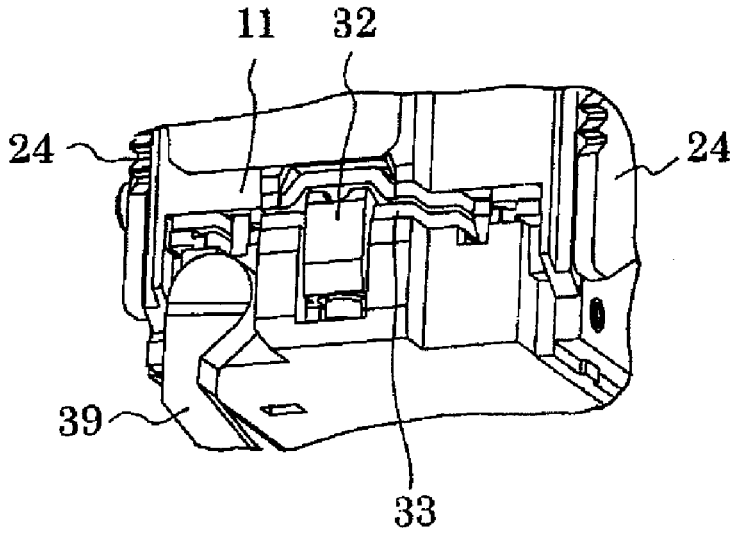
FIG. 14A is a perspective view of the staple exit portion of a staple feed device, showing a state where a pusher is advanced.
Figure 14B:
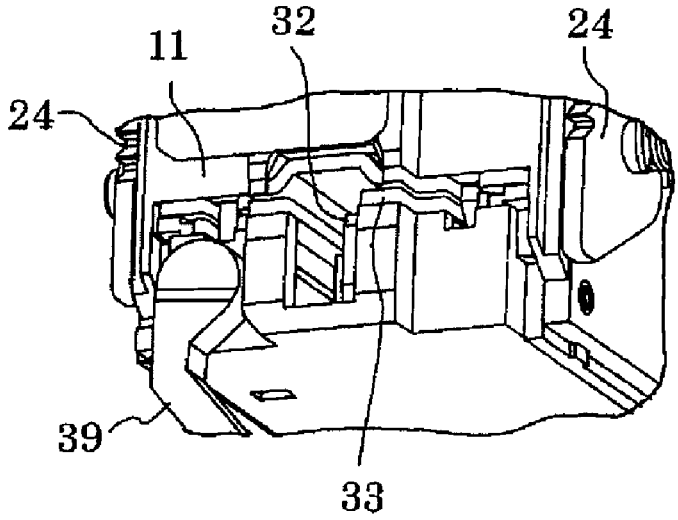
FIG. 14B is a perspective view of the staple exit portion of a staple feed device, showing a state where a pusher is moved backward.

FIGS. 14A and 14B respectively show the pusher 32 in an enlarged manner. Specifically, FIG. 14A shows a state where the pusher 32 is situated in the advance end position thereof and is projected slightly forwardly of the opening end of the front surface of the staple guide 33 of the magazine storage portion 11, and FIG. 14B shows a state where the pusher 32 is situated in the backward position thereof.

Figure 8A:
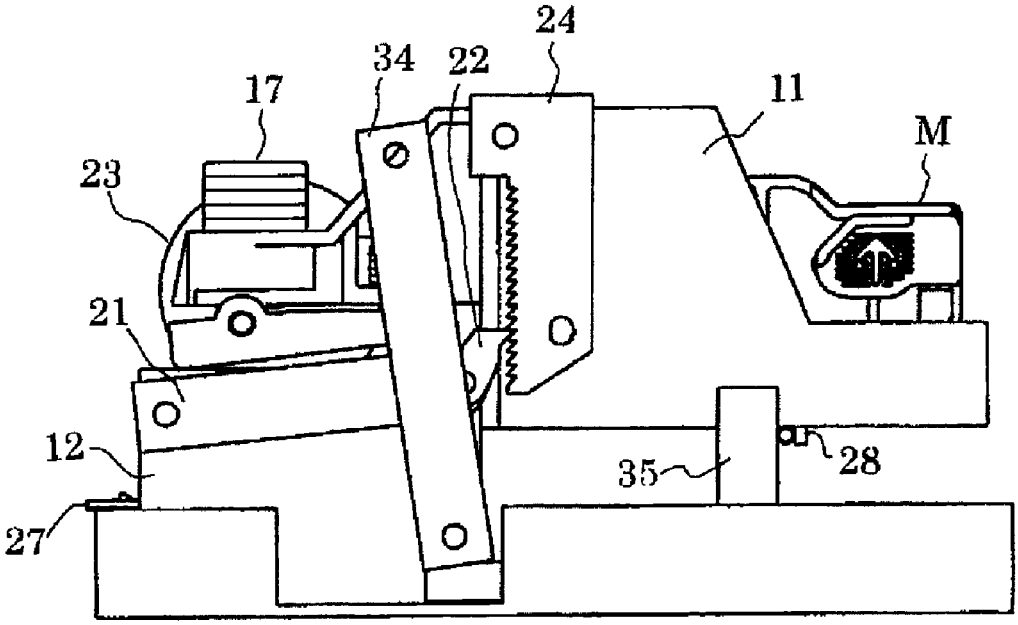
FIG. 8A is a side view of a staple feed device, showing its feed pawl backward operation.
Figure 8B:
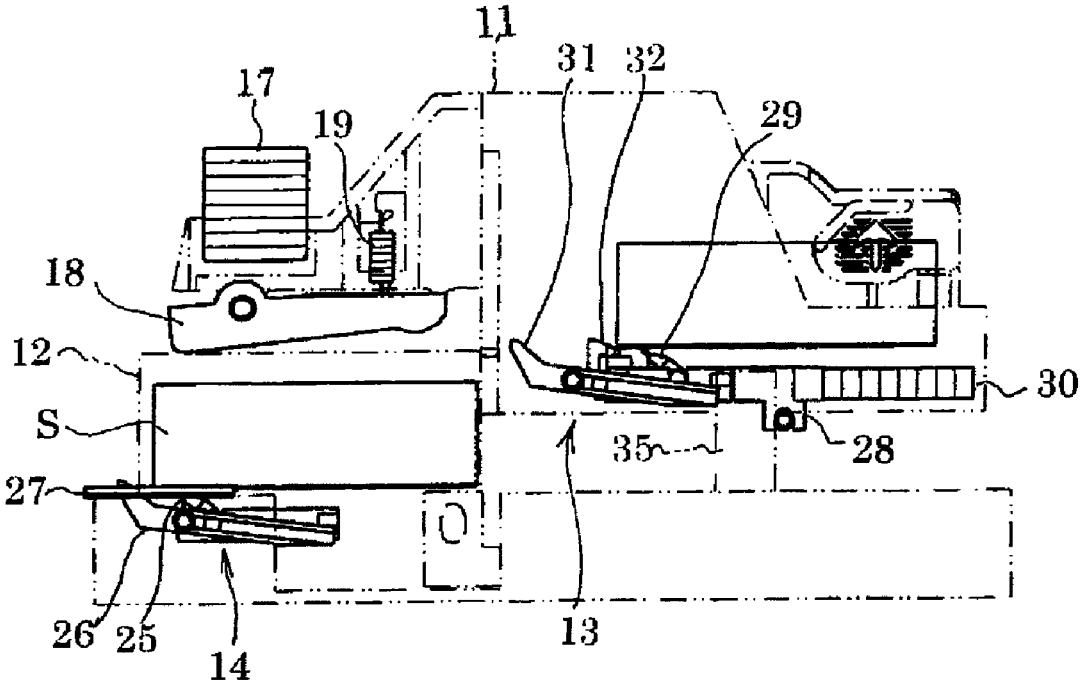
FIG. 8B is a section view of the staple feed device shown in FIG. 8A.

The initial state of the staple feed device shown in FIGS. 6A and 6B, and the lift-up operation of the staple feed device shown in FIGS. 7A and 7B are as previously described. Next, when a staple sheet is fed from the staple magazine M inside the magazine storage portion 11 to the staple sheet storage portion 12 disposed on the front side, as shown in FIGS. 8A and 8B, the lower end side of a feed link 34 is rotated backwardly from the lift-up state thereof shown in FIGS. 7A and 7B, a main slider 35 connected to the feed link 34 is allowed to move backward, whereby the slider 28 and feed pawl 29 of the first staple feed mechanism 13 are allowed to move backward to the backward end position thereof.

Figure 9A:
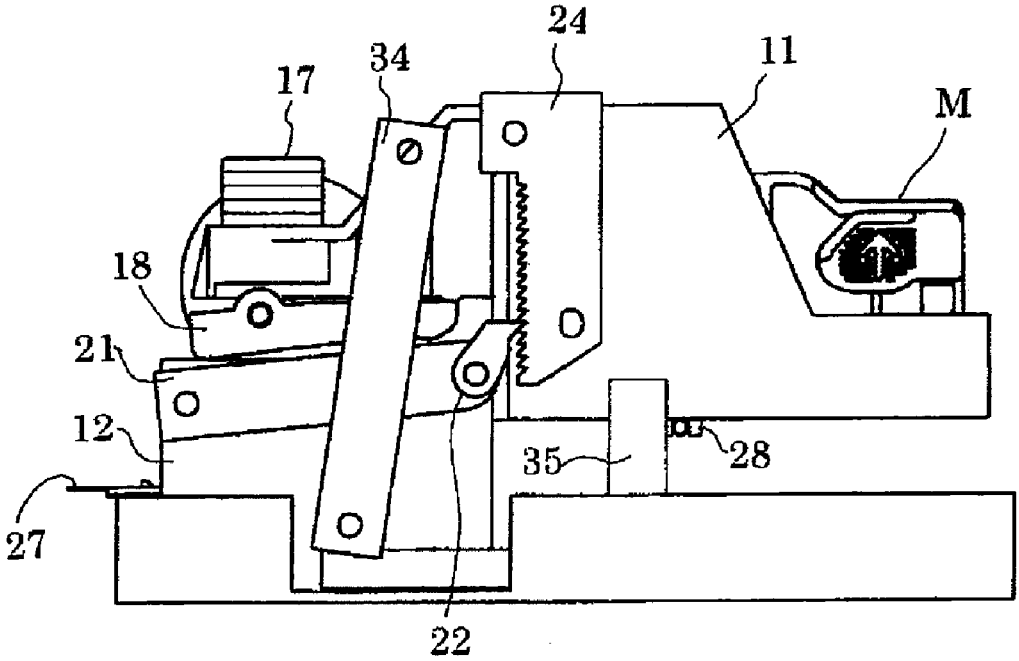
FIG. 9A is a side view of a staple feed device, showing its feed pawl advance operation.
Figure 9B:
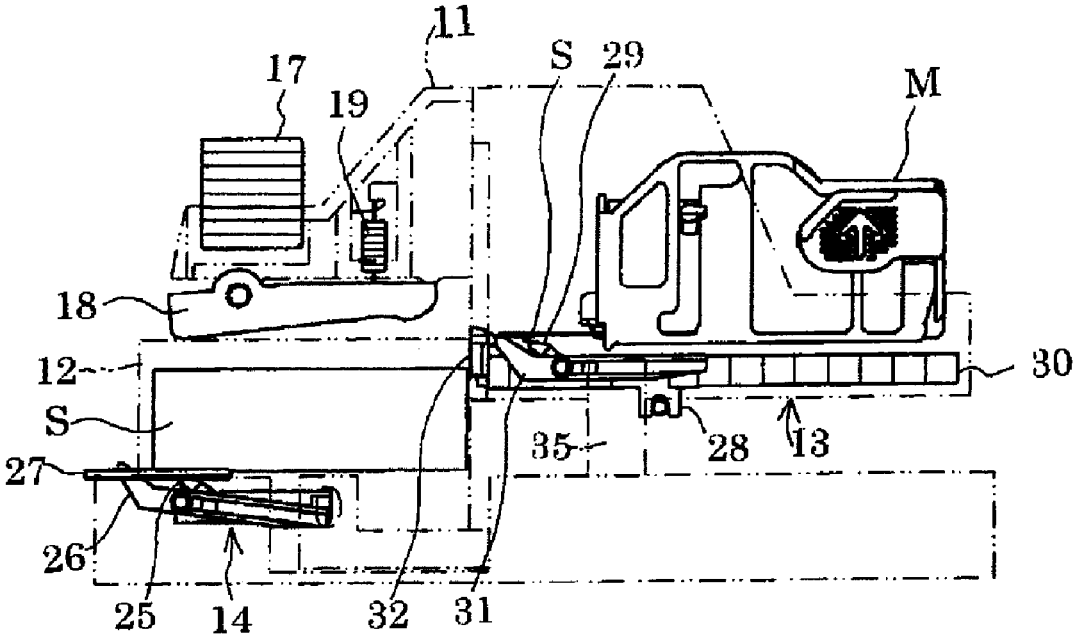
FIG. 9B is a section view of the staple feed device shown in FIG. 9A.

Subsequently, as shown in FIGS. 9A and 9B, the feed link 34 and main slider 35 are put into their advancing strokes, and thus the feed pawl 29 is engaged with a staple sheet S inside the staple magazine M to thereby move the staple sheet S forward. FIG. 9B shows a state in which the leading end of the staple sheet S is butted against the leading end of the staple sheet detecting lever 31 to thereby push down the leading end of the staple sheet detecting lever 31. The reciprocating operation of the feed pawl 29 is repeated several times until the staple sheet S is completely moved from the staple magazine M inside the magazine storage portion 11 into the staple sheet storage portion 12 disposed forwardly.

Figure 10A:
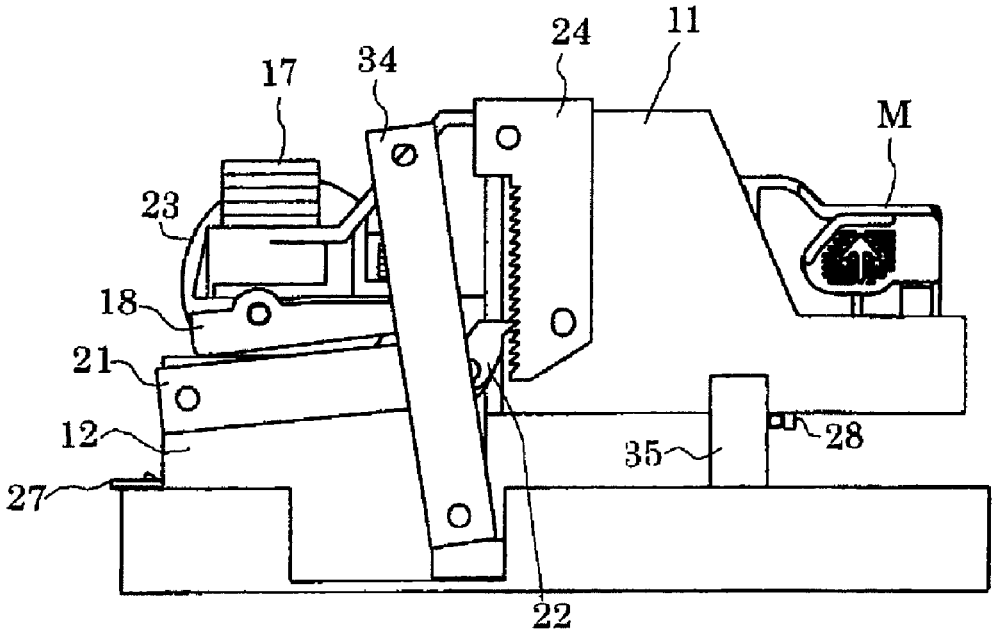
FIG. 10A is a side view of a staple feed device, showing its feed pawl backward operation.
Figure 10B:
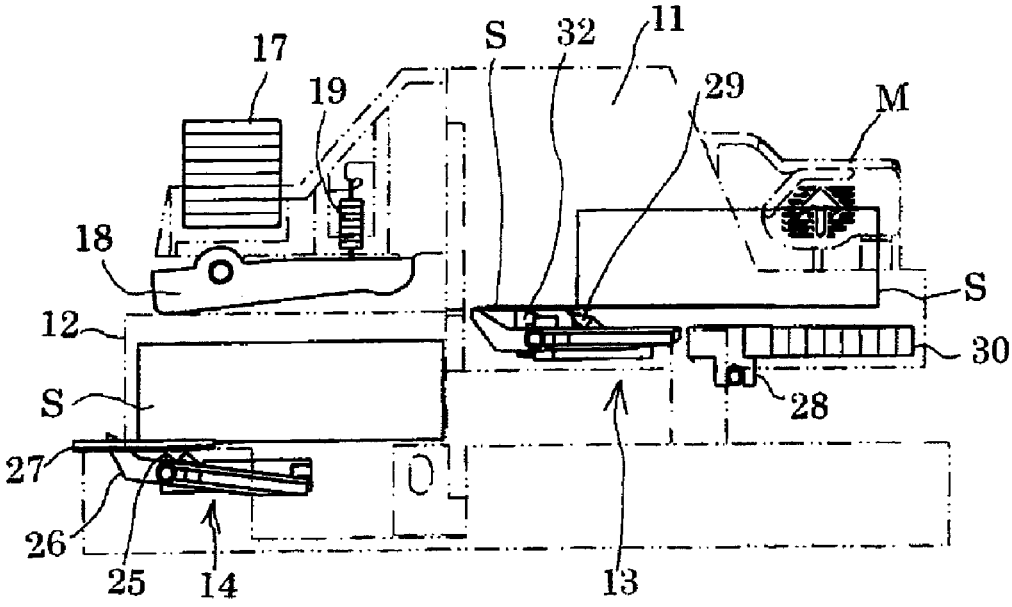
FIG. 10B is a section view of the staple feed device shown in FIG. 10A.
Figure 11A:
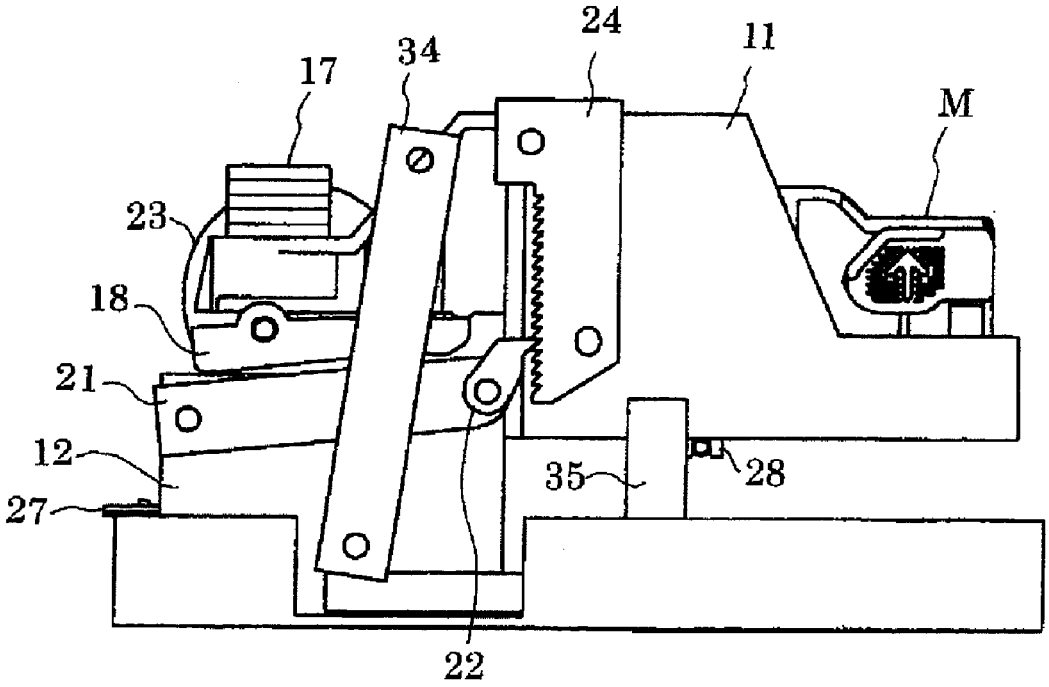
FIG. 11A is a side view of a staple feed device, showing its feed pawl advance operation.
Figure 11B:
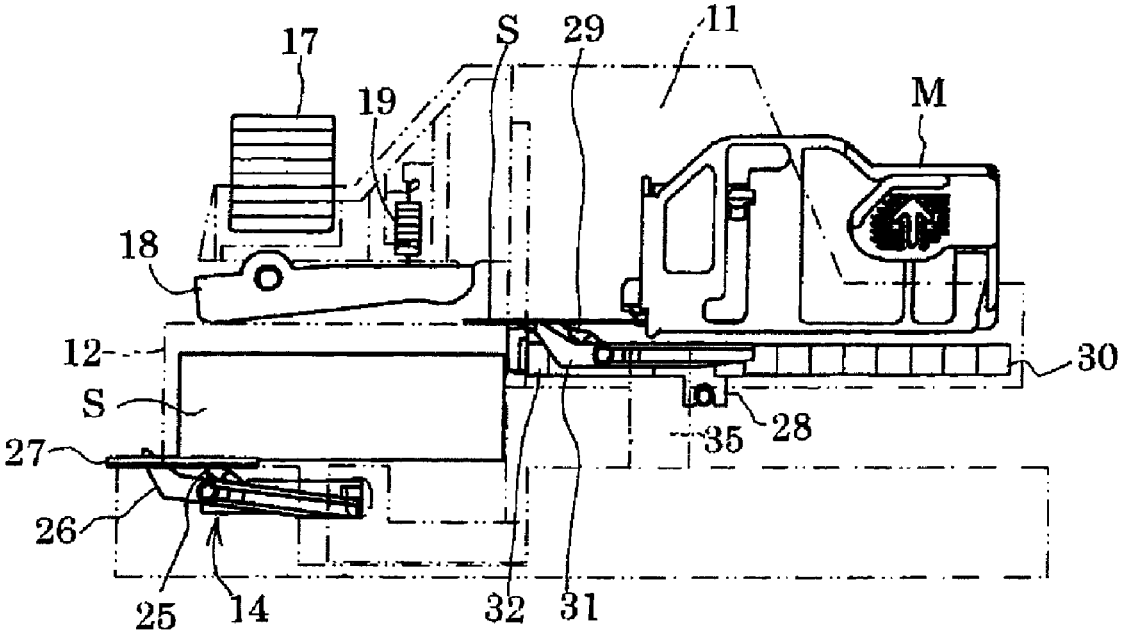
FIG. 11B is a section view of the staple feed device shown in FIG. 11A.

FIGS. 10A and 10B respectively show a process of a backward movement of the feed pawl that follow those shown in FIGS. 9A and 9B. Specifically, as described above, the backward stroke of the feed pawl 29 is limited by the rear end portion of the staple sheet detecting lever 31 and thus, at and from this stage on, the staple sheet S is fed more fractionally than in the first feeding stage thereof. This prevents the feed pawl 29 from touching the second staple sheet S from below inside the staple magazine M, thereby eliminating the occurrence of poor feeding such as sheet clogging. At this time, the pusher 32 is pushed and slid downward by the staple sheet S, and is resiliently contacted with the lower surface of the staple sheet S. In this state, as shown in FIGS. 11A and 11B, the staple sheet S is fed toward the staple sheet storage portion 12 on a front side.

Figure 12A:
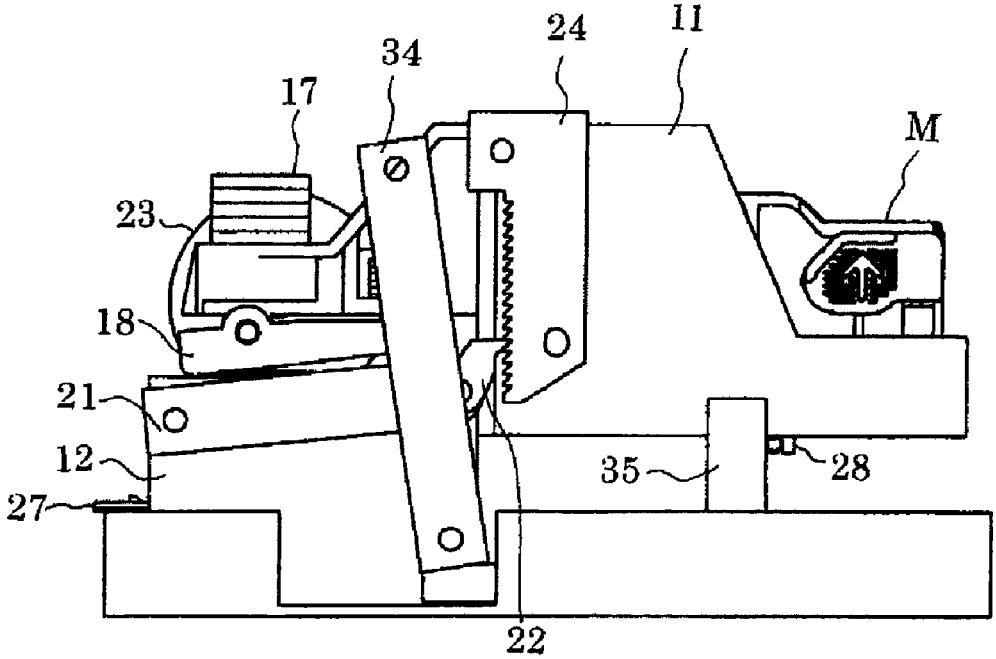
FIG. 12A is a side view of a staple feed device, showing its operation in a state where a feed pawl and a pusher are detached from a stapler sheet.
Figure 12B:
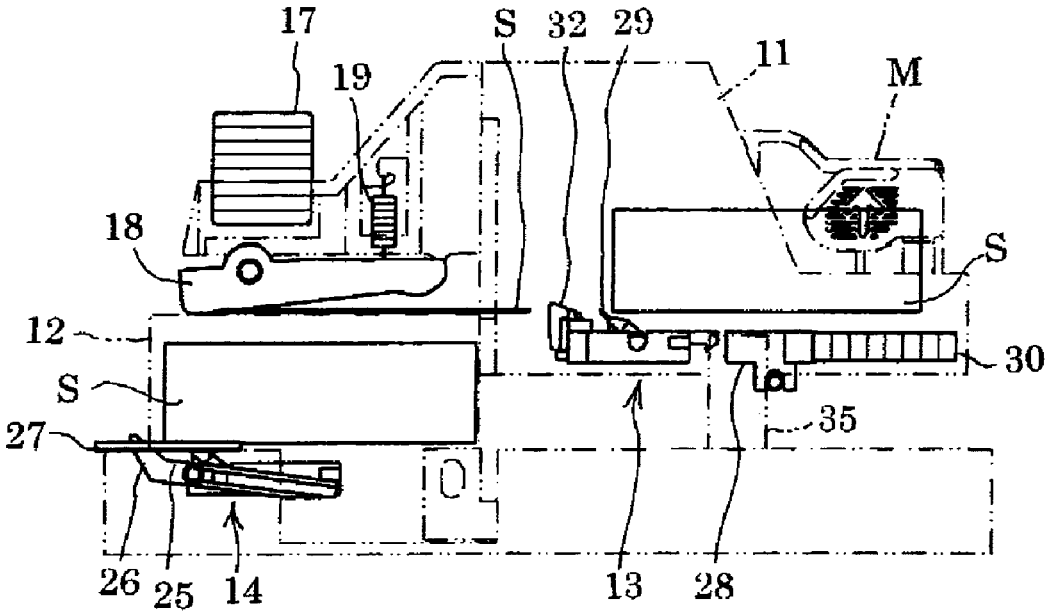
FIG. 12B is a section view of the staple feed device shown in FIG. 12A.

FIGS. 12A and 12B respectively show a state where, when most of the staple sheets S have entered the staple sheet storage portion 12 and the feed pawl 29 has moved backward, the feed pawl 29 and pusher 32 are detached from the staple sheet S. Since the staple sheet S, which has held the pusher 32, is moved forward, the pusher 32 is upwardly projected due to the biasing force of the spring.

Figure 13A:
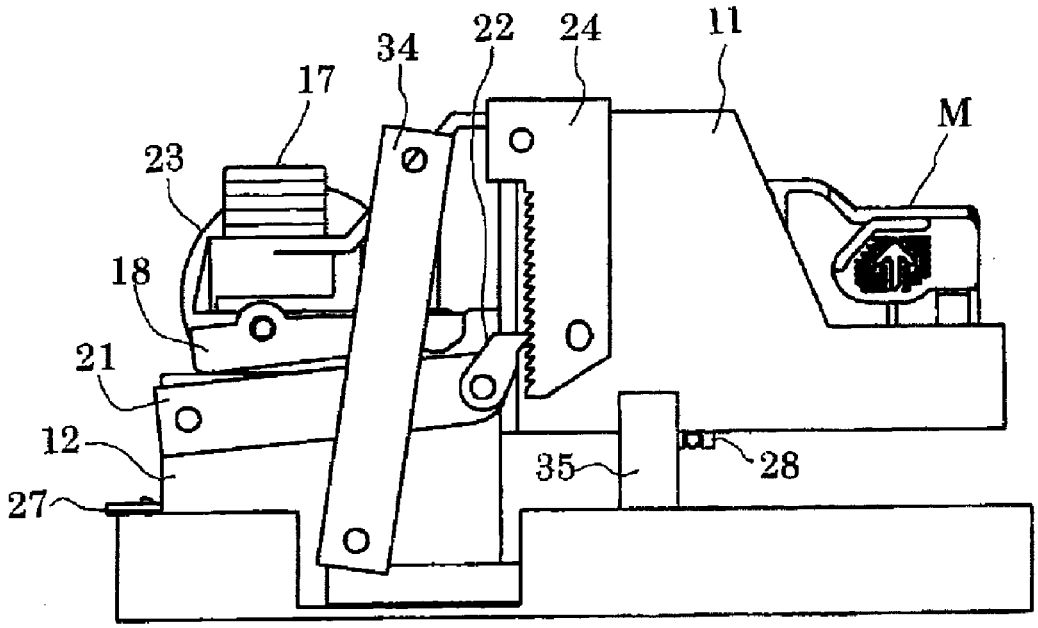
FIG. 13A is a side view of a staple feed device, showing its operation in a state where the front surface of a pusher pushes against the rear end of a stapler sheet.
Figure 13B:
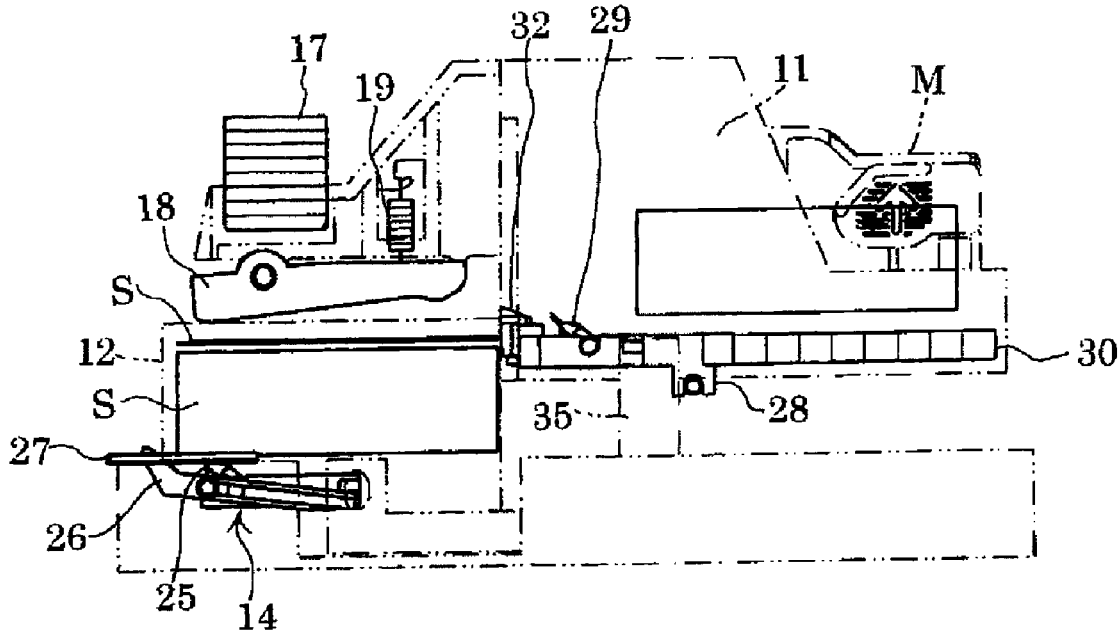
FIG. 13B is a section view of the staple feed device shown in FIG. 13A.

As shown in FIGS. 13A and 13B, in the feed pawl advancing strokes that follow the strokes shown in FIGS. 12A and 12B, the front surface of the pusher 32 disposed in front of the feed pawl 29 presses against the rear end of the staple sheet S to thereby push the staple sheet S into the staple sheet storage portion 12 completely.

Figure 15:
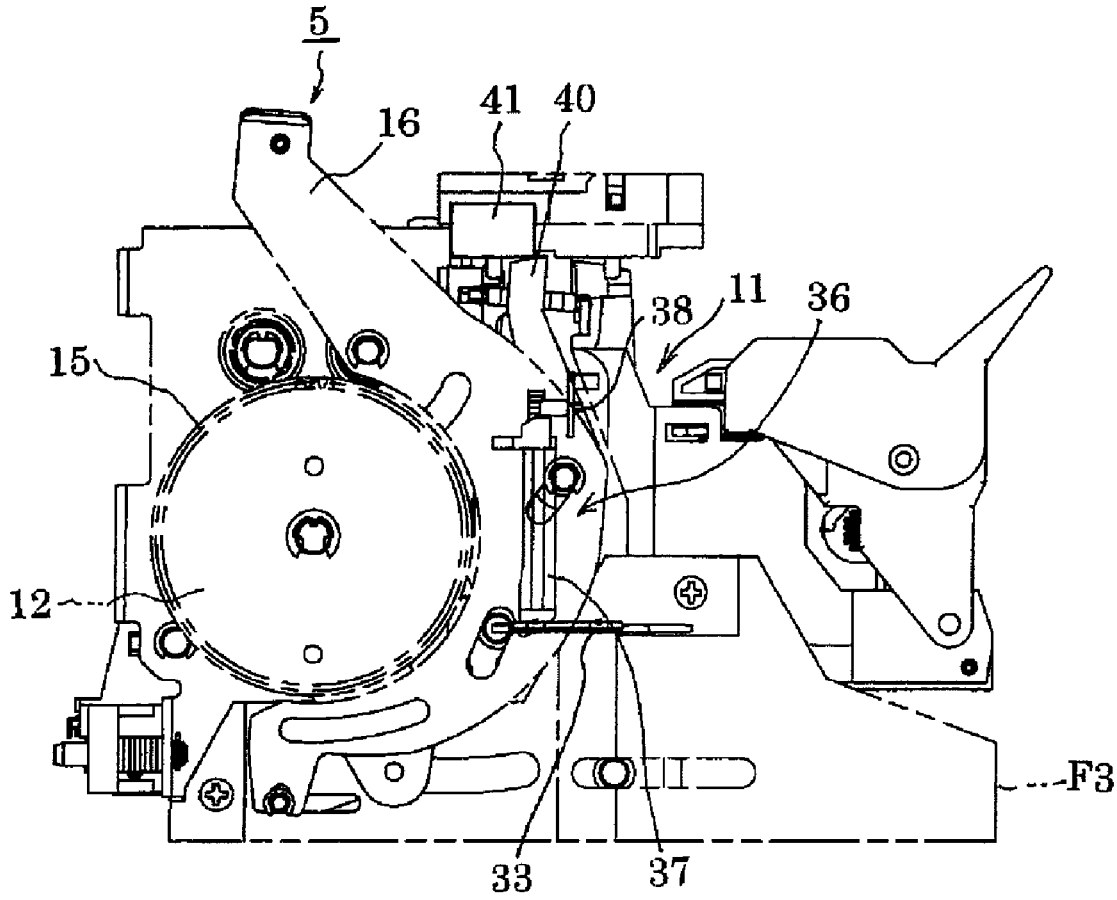
FIG. 15 is a side view of a staple feed device.
Figure 16:
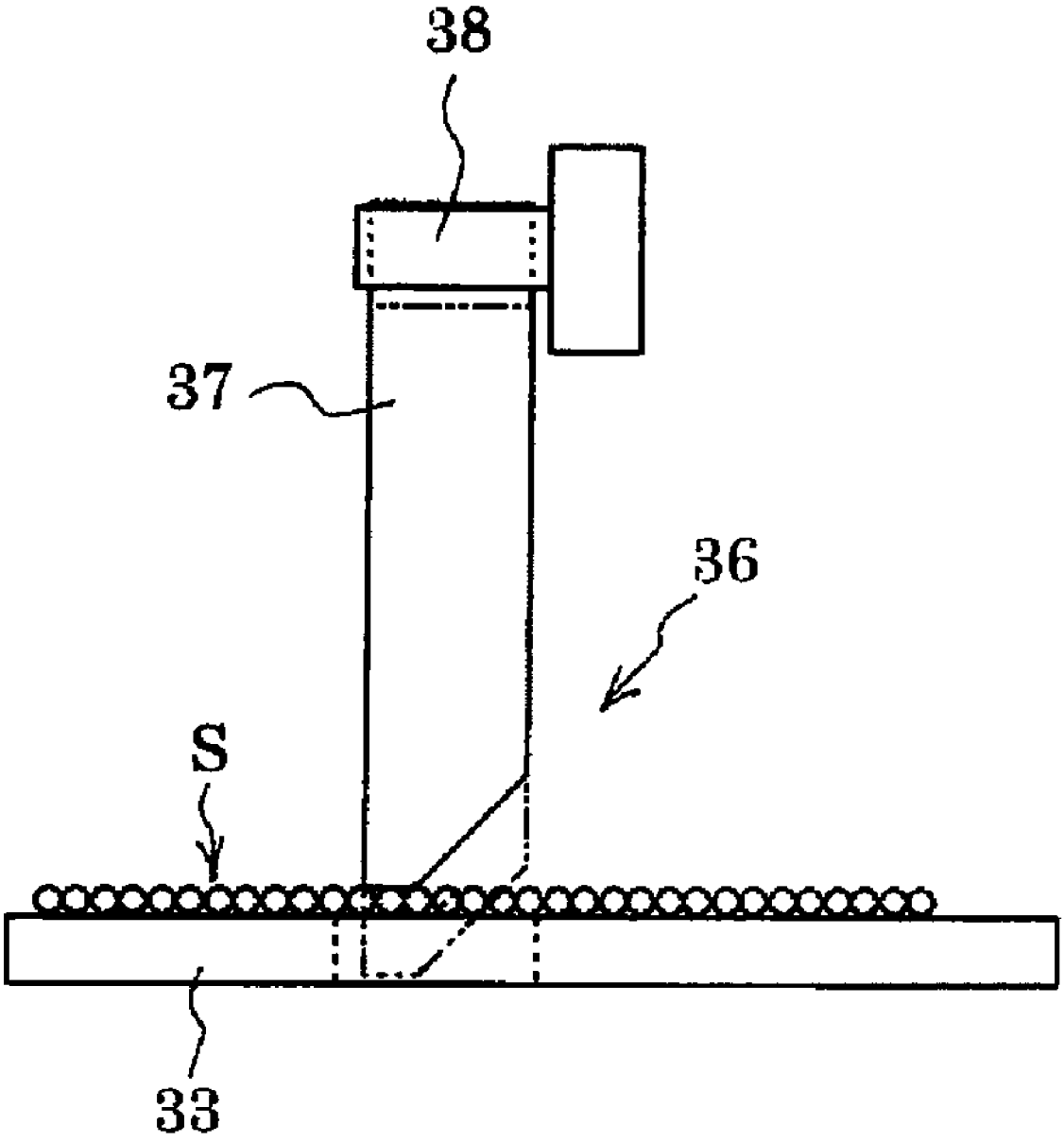
FIG. 16 is an explanatory view of the operation of a staple detecting sensor used in a staple feed device.

The movement of the staple sheet S into the staple sheet storage portion 12 is detected by a staple detecting sensor 36 which is disposed in the magazine storage portion 11. As shown in FIGS. 15 and 16, the staple detecting sensor 36 disposed in the front portion of the magazine storage portion 11 includes a sensor actuator 37 contactable with a staple guide 33 from above in the vicinity of the front end of the staple guide 33, and a photo interrupter 38 disposed upwardly of the center actuator 37. According to the upward and downward positions of the sensor actuator 37, the photo interrupter 38 turns on or off to thereby detect whether a staple sheet S is on the staple guide 33 or not.

When no staple sheet S is on the staple guide 33, as shown by a dot and dash line in FIG. 16, the sensor actuator 37 moves down and thus the upper end thereof is detached from the photo interrupter 38, so that the output of the photo interrupter turns off. When the staple sheet S is fed from the staple magazine M onto the staple guide 34, the front end of the staple sheet S is butted against the inclined surface of the lower surface of the actuator 37 to push up the sensor actuator 37 and thus the upper end of the sensor actuator 37 is moved into between the light emitting and light receiving portions of the photo interrupter 38, thereby turning on the output of the photo interrupter 38. That is, the output of the photo interrupter 38 turns off when the feed of the staple sheet S is started, it turns on when the staple sheet S is fed onto the staple guide 33, and it turns off when the feeding of the staple sheet S is completed.

After the feed completion is detected by the staple detecting sensor 36, the lift arm 21 is returned to its initial position by the cam mechanism, and the magazine storage portion 11 is moved downward by the compression coil spring 17, whereby the hold lever 18 holds the staple sheets inside the staple sheet storage portion 12 from above.

Also, by monitoring the signal of the staple detecting sensor 36, it can be checked whether a staple sheet is inside the staple magazine M or not. That is, when the staple sheet is present, the signal of the staple detecting sensor 36 in the staple feed operation, as described above, varies off, on and off. On the other hand, when there are no staple sheets, after initiation of the staple feed operation, the signal of the staple detecting sensor 36 does not vary from off to on. Therefore, when the reciprocating operation of the feed pawl is executed two or more times and the staple detecting sensor 36 signal does not turn on, it can be judged that there are no staple sheets. By notifying the absence of the staple sheet using a display plate or a buzzer, at the time when the staple sheet remains inside the staple sheet storage portion 12, the staple magazine M of the magazine storage portion 11 can be replaced. That is, the staple shortage can be prevented and thus the continuous binding operation can be executed perpetually.

Meanwhile, the vertical position of the magazine storage portion 11 varies according to the number of staple sheets inside the staple sheet storage portion 12. However, since there is used a ratchet mechanism as means for engaging the lift arm 21 and magazine storage portion 11 with each other, the lift amount of the magazine storage portion 11 can be kept constant regardless of the vertical portion of the magazine storage portion 11, which also can make constant the position relationship between the staple guide 33 of the lifted magazine storage portion 11 and the upper surface of the staple sheets inside the staple sheet storage portion 12. Therefore, the staple sheet S can be fed out from the magazine storage portion 11 just above the staple sheet S inside the staple sheet storage portion 12, which can prevent the occurrence of such an inconvenience that the fed-out staple sheet S drops off obliquely inside the staple sheet storage portion 12 and the staple sheet storage portion 12 can be clogged with such staple sheet S.

Also, in view of the fact that the vertical position of the magazine storage portion 11 varies in accordance with the number of staple sheets S remaining inside the staple sheet storage portion 12, in order to be able to feed a staple sheet to the staple sheet storage portion 12 regardless of the vertical position of the magazine storage portion 11, the back surface (the surface on the magazine storage portion side 11) of the staple sheet storage portion 12 is formed open. Thus, according to the arrangement specifications of the electric stapler (the electric stapler is not always arranged horizontally) and the installation condition thereof, there is raised a fear that the staple sheets inside the staple sheet storage portion 12 can move backwardly or drop down. As means for preventing the staple sheet S against such backward movement, as shown in FIG. 17, there is provided a gate bar 39 which hangs down from the vicinity of the staple sheet exit of the magazine storage portion 11.

Figure 17:
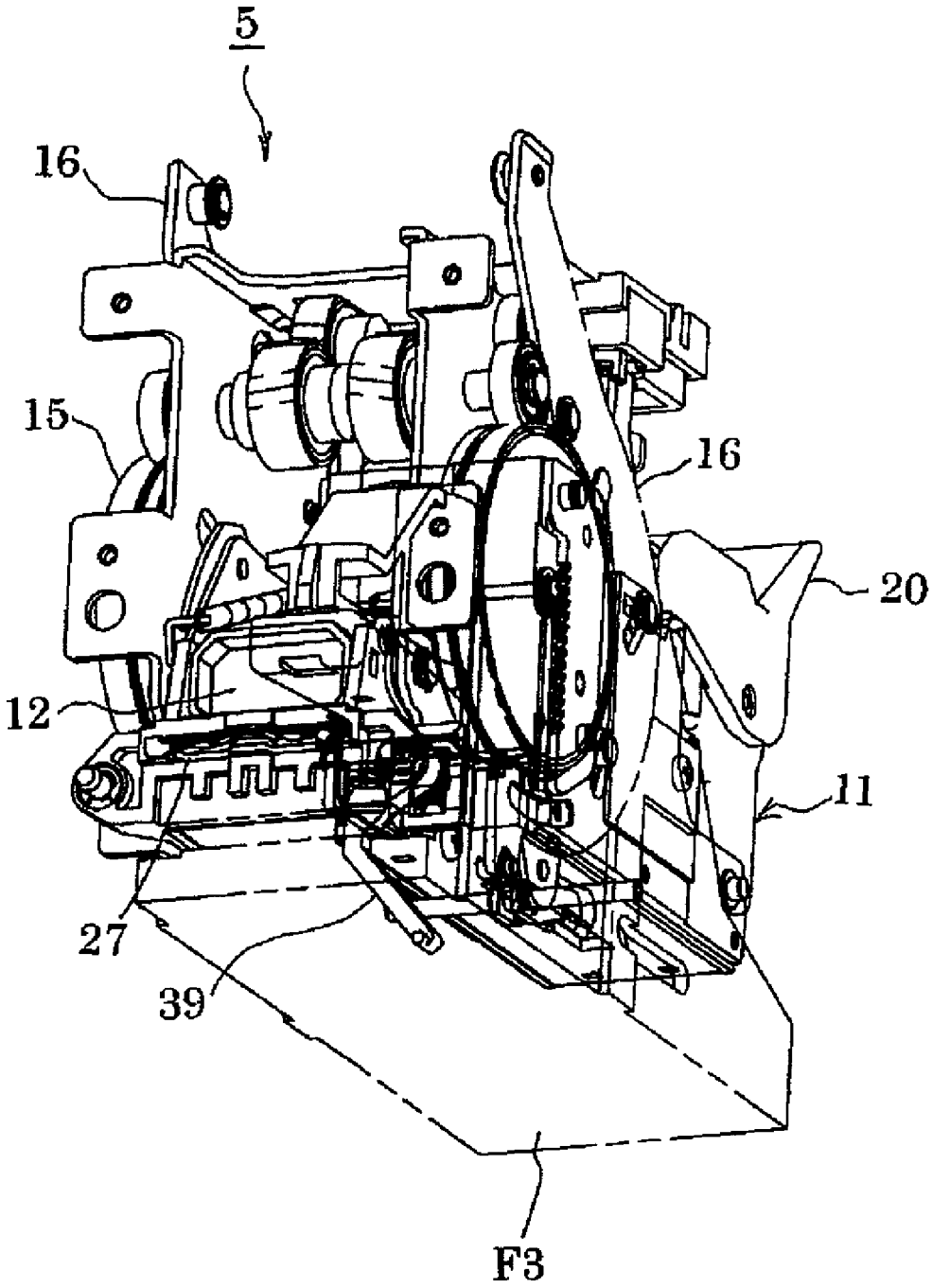
FIG. 17 is a perspective view of a staple feed device.

FIG. 17 is a perspective view of the staple feed device 5, when it is viewed from the front surface side thereof. In FIG. 17, the L-shaped gate bar 39 hangs down just below the front end of the staple guide 33 of the magazine storage portion 11, while the lower end of the gate bar 39 is contacted with the inside bottom surface of the frame F3. FIG. 14 shows the details of the mounting portion of the gate bar 39.

Figure 18B:
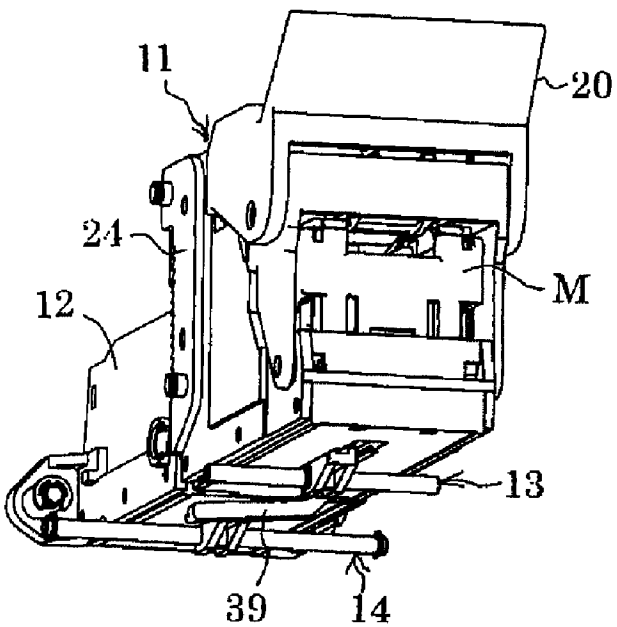
FIG. 18B is a perspective view of a magazine storage portion and a staple sheet storage portion, showing a state in which the magazine storage portion is lowered down.
Figure 18A:
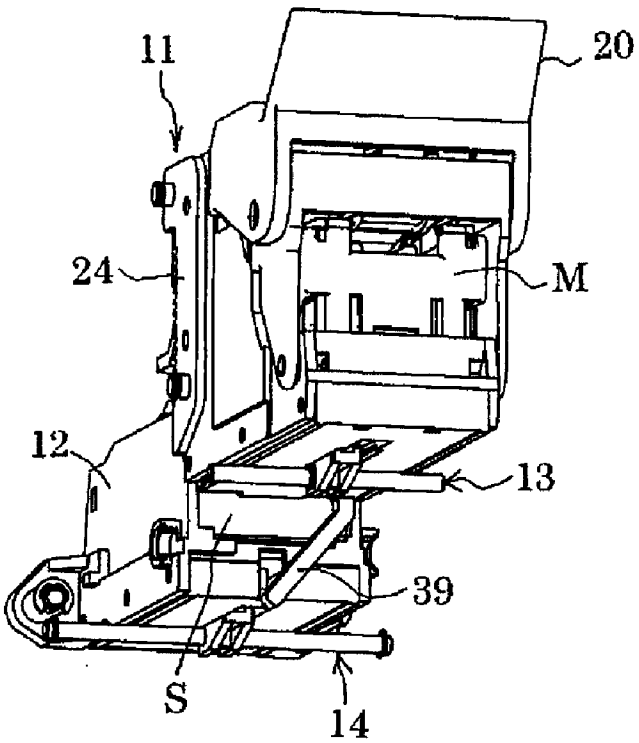
FIG. 18A is a perspective view of a magazine storage portion and a staple sheet storage portion, showing a state in which the magazine storage portion is lifted up.

FIGS. 18A and 18B are respectively views of the magazine storage portion 11 and staple sheet storage portion 12, when they are viewed from the back surface side thereof. Specifically, FIG. 18A shows a state in which the magazine storage portion 11 is lifted up, while FIG. 18B shows a state in which the magazine storage portion 11 is held at the most lowered position thereof. The gate bar 39 hangs down due to its own weight and the lower end of the gate bar 39 is contacted with the bottom plate portion of a frame (not shown). Therefore, the gate bar 39 can be rotated according to the height position of the magazine storage portion 11. However, a portion of the opening of the back surface of the staple sheet storage portion 12 is always closed to thereby prevent the staple sheets inside the staple sheet storage portion 12 from moving backward.

Meanwhile, the above-described operation to feed the staple sheet S from the magazine storage portion 11 to the staple sheet storage portion 12 can be carried out not only while a stapling processing is in execution but also while it is stopped. The timing and interval of the staple sheet feeding operation can be set optionally, and the number of staple sheets to be fed one time can be set optionally.

However, during the staple sheet feeding operation, the magazine storage portion 11 floats upward and thus the staple sheet of the staple sheet storage portion 12 is not held by the hold lever 18 of the magazine storage portion 11. Therefore, it is desirable not to carry out an operation to pull out a next staple sheet from the staple sheet storage portion 12.

In other words, in a state where the staple sheet is not held by the hold lever 18, when the feed pawl 25 of the second staple feed mechanism 14 pulls out an unused staple sheet from the staple sheet storage portion 12, there is a fear that the feed pawl 25 cannot catch the lower surface of the staple sheet but can slip off it, resulting in the poor feeding of the staple sheet.

Therefore, the operation to feed the staple sheet from the magazine storage portion 11 to the staple sheet storage portion 12 may preferably be carried out in a state where the length of the staple sheet on the staple guide 27 of the staple sheet storage portion 12 still remains there a certain degree and thus an operation to pull out a next staple sheet is not started yet.

Figure 19B:
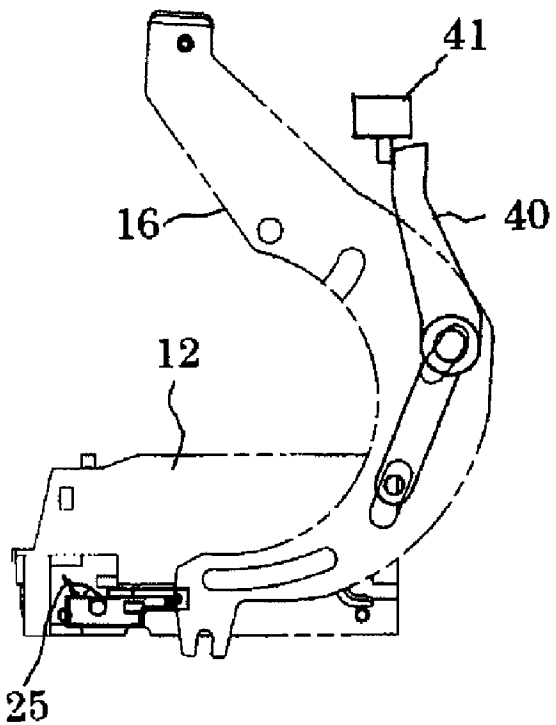
FIG. 19B is an explanatory view of the operation of a feed pawl position detecting lever.
Figure 19A:
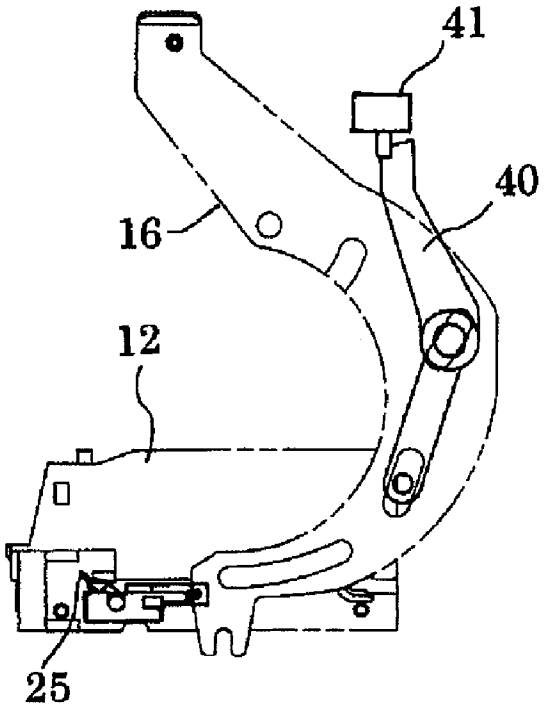
FIG. 19A is an explanatory view of the operation of a feed pawl position detecting lever.

In order to control the timing of the staple sheet feeding operation, the electric stapler 1 includes means for detecting the remaining amount (length) of the staple sheet being currently fed to the driver. As shown in FIG. 15, on the frame F3, there is mounted a feed pawl position detecting lever 40. The lower end portion of the feed pawl position detecting lever 40, as shown in FIGS. 19A and 19B, is engaged with a staple feed cam lever 16 and thus, with the vertical intermediate portion thereof as a fulcrum, the feed pawl position detecting lever 40 is oscillated back and forth in linking with the staple feed cam lever 16. At the upper end position of the feed pawl position detecting lever 40, there is disposed a photo interrupter 41. And, the photo interrupter 41 is turned on and off according to the rotation angles of the feed pawl position detecting lever 40.

The position of the feed pawl 25 of the second staple feed mechanism 14 varies depending on the length (remaining amount) of the staple sheet on the staple guide 27. That is, until the rear end of the staple sheet passes through the leading end position of the staple sheet detecting lever 26, the backward stroke of the feed pawl 25 is limited and is thus caused to move backward with a short stroke. When the leading staple is ejected, the feed pawl 25 is allowed to advance by an amount equivalent to the line diameter of a single staple and also is allowed to move backward by an amount equivalent to the line diameter of a single staple, whereby the feed pawl 25 is caught by a staple one behind (more specifically, between the two staples). In this manner, when the staple sheet still has a remaining amount, the stroke of the feed pawl 25 is equal to the line diameter of a single staple.

On the other hand, when the consumption of the staple sheet on the staple guide progresses and thus the feed pawl 25 is caught by the rear end of the staple sheet, with the consumption of the staple, the feed pawl 25 moves forwardly of the position to which it has advanced up until then.

FIG. 19A shows the stop position of the advancing movement of the feed pawl 25 when the staple sheet has a remaining amount. At this time, the upper end of the feed pawl position detecting lever 40 exists between the light emitting and receiving portions of the photo interrupter 41 and shields the light, whereby the photo interrupter 41 turns off. On the other hand, FIG. 19B shows a state where the consumption of the staple sheet progresses and the feed pawl 25 has moved forwardly beyond its previous advance position. In this case, the upper end of the feed pawl position detecting lever 40 is rotated further backwardly and is thereby moved out from between the light emitting and receiving positions of the photo interrupter 41, whereby the photo interrupter 41 turns on.

Accordingly, when the photo interrupter 41 is turned into such an on state as shown in FIG. 19B, if the electric stapler is controlled such that it does not carry out the operation to feed the staple sheet from the magazine storage portion 11 to the staple sheet storage portion 12, it is possible to prevent the occurrence of the poor feeding of the staple from the staple sheet storage portion 12.

The present invention is not limited to the above-described embodiments but, of course, various changes and modifications can be made without departing from the technological range of the invention and these changes and modifications also fall within the scope of the invention.

While the present invention has been described heretofore in detail and also with reference to the specific embodiments thereof, it is obvious to a person skilled in the art that various changes and modification are possible without departing from the spirit and scope of the invention.

The present application is based on Japanese Patent Application No. 2005-295167 filed on Oct. 7, 2005 the content of which is incorporated herein by reference.

INDUSTRIAL APPLICABILITY

In an electric stapler, a continuous binding processing beyond a capacity of a staple magazine becomes possible.

The invention claimed is:

1. An electric stapler comprising:

a staple sheet storage portion for storing a stack of staple sheets;

a magazine storage portion disposed on a rear side of the staple sheet storage portion to store a staple magazine;

a first staple feed mechanism operable to pull out a staple sheet from the staple magazine and to feed the staple sheet to the staple sheet storage portion;

a second staple feed mechanism operable to pull out the staple sheet from the staple sheet storage portion and to feed the staple sheet to a driver unit; and a lift mechanism operable to lift up the magazine storage portion, wherein the first staple feed mechanism feeds the staple sheet to the staple sheet storage portion in a state in which the lift mechanism keeps a height of the staple sheet to be pulled out from the staple magazine higher than a height of an upper surface of a stack of the staple sheets inside the staple sheet storage portion.

2. The electric stapler according to claim 1, further comprising a hold member for holding a staple sheet, wherein a front portion of the magazine storage portion extends toward an upper side of the staple sheet storage portion and is downwardly biased by a biasing member, and the hold member is disposed on the front portion of the magazine storage portion to hold the staple sheets inside the staple sheet storage portion in accordance with the downward biasing of the front portion of the magazine storage portion by the biasing member.

3. The electric stapler according to claim 2, further comprising:

a sensor which detects a position of a feed pawl of the second staple feed mechanism; and control means, wherein, if the sensor detects that the feed pawl is not positioned at a previously set position, the control means does not execute an operation of the first staple feed mechanism to feed the staple sheet from the magazine storage portion to the staple sheet storage portion.

4. The electric stapler according to claim 1, wherein the lift mechanism comprises:

a ratchet rack provided on the magazine storage portion and extending in a vertical direction;

a lift arm to be driven up and down; and a ratchet pawl provided on the lift arm, wherein the ratchet pawl engages with the ratchet rack only when the lift arm is moved up to lift up the magazine storage portion by a certain lift amount.

5. The electric stapler according to claim 1, further comprising a gate bar hanging down from a front surface of the magazine storage portion so as to be upwardly and downwardly movable, wherein a back surface of the staple sheet storage portion is formed with an opening, and the gate bar constantly closes a portion of the opening on the back surface of the staple sheet storage portion to prevent the staple sheets inside the staple sheet storage portion from moving and dropping out.

6. An electric stapler comprising:

a staple sheet storage portion for storing a stack of staple sheets;

a magazine storage portion disposed on a rear side of the staple sheet storage portion to store a staple magazine;

a first staple feed mechanism operable to pull out a staple sheet from the staple magazine and to feed the staple sheet to the staple sheet storage portion;

a second staple feed mechanism operable to pull out the staple sheet from the staple sheet storage portion and to feed the staple sheet to a driver unit comprising a driver and a forming plate, a first configuration of the stapler, wherein the staple magazine is loaded with staple sheets, the staple magazine is disposed in the magazine storage portion, and the staple sheet storage portion stores a stack of staple sheets; and a second configuration of the stapler wherein the staple magazine is empty of staple sheets, the staple magazine is removed from the magazine storage portion, and the staple sheet storage portion stores a stack of staple sheets;

wherein the stapler is adapted to allow the staple magazine to be to be replaced when the staple magazine is empty at the same time that the staple sheet storage portion stores a stack of staple sheets so that the staple sheets in the staple sheet storage portion continue to feed to the driver unit when the staple magazine is replaced.

7. The electric stapler according to claim 1, further comprising:

a sensor disposed near a staple sheet pulling-out opening of the magazine storage portion to detect whether a staple sheet is present or not; and control means, wherein, if the sensor does not detect a presence of the staple sheet during a certain time of staple sheet feeding operations of the first staple feed mechanism, the control means judges that there are no staple sheets inside the staple magazine and displays or warns that there are no staple sheets.

8. The electric stapler according to claim 6, wherein the first staple feed mechanism comprises:

a feed pawl;

a feed pawl hold member; and a pusher disposed on a leading end of the feed pawl hold member and having an upper surface which is rearwardly inclined, wherein the pusher is upwardly biased by a biasing member, the pusher is retracted downward when the upper surface thereof is pressed by the staple sheet while the staple sheet is being fed from the magazine storage portion to the staple sheet storage portion, and the upper surface projects into a staple sheet feeding passage so that the pusher pushes a rear end of the staple sheet when the staple sheet passes through the pusher.

* * * * *